US008137816B2

(12) United States Patent
Fang et al.

(10) Patent No.: US 8,137,816 B2
(45) **Date of Patent: *Mar. 20, 2012**

(54) COMPOSITE ARTICLES

(75) Inventors: X. Daniel Fang, Brentwood, TN (US); Craig W. Morton, Nolensville, TN (US); David J. Wills, Franklin, TN (US)

(73) Assignee: TDY Industries, Inc., Pittsburgh, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/850,003

(22) Filed: Aug. 4, 2010

(65) Prior Publication Data

US 2010/0303566 A1 Dec. 2, 2010

Related U.S. Application Data

(63) Continuation of application No. 11/687,343, filed on Mar. 16, 2007, now Pat. No. 7,846,551.

(51) Int. Cl.
*B32B 9/00* (2006.01)

(52) U.S. Cl. ..... 428/472; 428/698; 428/627; 428/701

(58) Field of Classification Search ..... None
See application file for complete search history.

(56) References Cited

U.S. PATENT DOCUMENTS

| | | | |
|---|---|---|---|
| 1,509,438 | A | 9/1924 | Miller |
| 1,530,293 | A | 3/1925 | Breitenstein |
| 1,808,138 | A | 6/1931 | Hogg et al. |
| 1,811,802 | A | 6/1931 | Newman |
| 1,912,298 | A | 5/1933 | Newman |
| 2,054,028 | A | 9/1936 | Benninghoff |
| 2,093,507 | A | 9/1937 | Bartek |
| 2,093,742 | A | 9/1937 | Staples |
| 2,093,986 | A | 9/1937 | Staples |
| 2,246,237 | A | 9/1941 | Benninghof |
| 2,283,280 | A | 5/1942 | Nell |
| 2,299,207 | A | 10/1942 | Bevillard |
| 2,422,994 | A | 6/1947 | Taylor |
| 2,819,958 | A | 1/1958 | Abkowitz et al. |
| 2,819,959 | A | 1/1958 | Abkowitz et al. |
| 2,906,654 | A | 9/1959 | Abkowitz |
| 2,954,570 | A | 10/1960 | Couch |

(Continued)

FOREIGN PATENT DOCUMENTS

| | | |
|---|---|---|
| AU | 695583 | 2/1998 |

(Continued)

OTHER PUBLICATIONS

Coyle, T.W. and A. Bahrami, "Structure and Adhesion of Ni-WC Plasma Spray Coatings," Thermal Spray, Surface Engineering via Applied Research, Proceedings of the 1st International Thermal Spray Conference, May 8-11, 2000, Montreal, Quebec, Canada, 2000, pp. 251-254.

(Continued)

*Primary Examiner* — Timothy Speer
(74) *Attorney, Agent, or Firm* — K & L Gates LLP; Patrick J. Viccaro; John E. Grosselin, III

(57) ABSTRACT

A composite article includes a first composite material and a second composite material. The first composite material and the second composite material individually comprise hard particles in a binder. A concentration of ruthenium in the binder of the first composite material is different from a concentration of ruthenium in the binder of the second composite material.

24 Claims, 16 Drawing Sheets

U.S. PATENT DOCUMENTS 3,041,641 A 7/1962 Hradek et al.
3,093,850 A 6/1963 Kelso
3,368,881 A 2/1968 Abkowitz et al.
3,471,921 A 10/1969 Feenstra
3,490,901 A 1/1970 Hachisuka et al.
3,581,835 A 6/1971 Stebley
3,629,887 A 12/1971 Urbanic
3,660,050 A 5/1972 Iler et al.
3,757,879 A 9/1973 Wilder et al.
3,776,655 A 12/1973 Urbanic
3,782,848 A 1/1974 Pfeifer
3,806,270 A 4/1974 Tanner et al.
3,812,548 A 5/1974 Theuerkaue
RE28,645 E 12/1975 Aoki et al.
3,942,954 A 3/1976 Frehn
3,987,859 A 10/1976 Lichte
4,009,027 A 2/1977 Naidich et al.
4,017,480 A 4/1977 Baum
4,047,828 A 9/1977 Makely
4,094,709 A 6/1978 Rozmus
4,097,180 A 6/1978 Kwieraga
4,097,275 A 6/1978 Horvath
4,106,382 A 8/1978 Salje et al.
4,126,652 A 11/1978 Oohara et al.
4,128,136 A 12/1978 Generoux
4,170,499 A 10/1979 Thomas et al.
4,198,233 A 4/1980 Frehn
4,221,270 A 9/1980 Vezirian
4,229,638 A 10/1980 Lichte
4,233,720 A 11/1980 Rozmus
4,255,165 A 3/1981 Dennis et al.
4,270,952 A 6/1981 Kobayashi
4,277,106 A 7/1981 Sahley
4,306,139 A 12/1981 Shinozaki et al.
4,311,490 A 1/1982 Bovenkerk et al.
4,325,994 A 4/1982 Kitashima et al.
4,327,156 A 4/1982 Dillon et al.
4,340,327 A 7/1982 Martins
4,341,557 A 7/1982 Lizenby
4,389,952 A 6/1983 Dreier et al.
4,396,321 A 8/1983 Holmes
4,398,952 A 8/1983 Drake
4,478,297 A 10/1984 Radtke
4,499,048 A 2/1985 Hanejko
4,499,795 A 2/1985 Radtke
4,526,748 A 7/1985 Rozmus
4,547,104 A 10/1985 Holmes
4,547,337 A 10/1985 Rozmus
4,550,532 A 11/1985 Fletcher, Jr. et al.
4,552,232 A 11/1985 Frear
4,553,615 A 11/1985 Grainger
4,554,130 A 11/1985 Ecer
4,562,990 A 1/1986 Rose
4,574,011 A 3/1986 Bonjour et al.
4,587,174 A 5/1986 Yoshimura et al.
4,592,685 A 6/1986 Beere
4,596,694 A 6/1986 Rozmus
4,597,730 A 7/1986 Rozmus
4,604,106 A 8/1986 Hall
4,605,343 A 8/1986 Hibbs, Jr. et al.
4,609,577 A 9/1986 Long
4,630,693 A 12/1986 Goodfellow
4,642,003 A 2/1987 Yoshimura
4,649,086 A 3/1987 Johnson
4,656,002 A 4/1987 Lizenby et al.
4,662,461 A 5/1987 Garrett
4,667,756 A 5/1987 King et al.
4,686,080 A 8/1987 Hara et al.
4,686,156 A 8/1987 Baldoni, II et al.
4,694,919 A 9/1987 Barr
4,708,542 A 11/1987 Emanuelli
4,722,405 A 2/1988 Langford
4,729,789 A 3/1988 Ide et al.
4,743,515 A 5/1988 Fischer et al.
4,744,943 A 5/1988 Timm
4,749,053 A 6/1988 Hollingshead
4,752,159 A 6/1988 Howlett
4,752,164 A 6/1988 Leonard, Jr.
4,779,440 A 10/1988 Cleve et al.
4,809,903 A 3/1989 Eylon et al.
4,838,366 A 6/1989 Jones
4,861,350 A 8/1989 Phaal et al.
4,871,377 A 10/1989 Frushour
4,884,477 A 12/1989 Smith et al.
4,889,017 A 12/1989 Fuller et al.
4,899,838 A 2/1990 Sullivan et al.
4,919,013 A 4/1990 Smith et al.
4,923,512 A 5/1990 Timm et al.
4,956,012 A 9/1990 Jacobs et al.
4,968,348 A 11/1990 Abkowitz et al.
4,991,670 A 2/1991 Fuller et al.
5,000,273 A 3/1991 Horton et al.
5,030,598 A 7/1991 Hsieh
5,032,352 A 7/1991 Meeks et al.
5,041,261 A 8/1991 Buljan et al.
5,049,450 A 9/1991 Dorfman et al.
RE33,753 E 11/1991 Vacchiano et al.
5,067,860 A 11/1991 Kobayashi et al.
5,090,491 A 2/1992 Tibbitts et al.
5,092,412 A 3/1992 Walk
5,098,232 A 3/1992 Benson
5,110,687 A 5/1992 Abe et al.
5,112,162 A 5/1992 Hartford et al.
5,112,168 A 5/1992 Glimpel
5,116,659 A 5/1992 Glatzle et al.
5,127,776 A 7/1992 Glimpel
5,161,898 A 11/1992 Drake
5,174,700 A 12/1992 Sgarbi et al.
5,179,772 A 1/1993 Braun et al.
5,186,739 A 2/1993 Isobe et al.
5,203,513 A 4/1993 Keller et al.
5,203,932 A 4/1993 Kato et al.
5,232,522 A 8/1993 Doktycz et al.
5,266,415 A 11/1993 Newkirk et al.
5,273,380 A 12/1993 Musacchia
5,281,260 A 1/1994 Kumar et al.
5,286,685 A 2/1994 Schoennahl et al.
5,305,840 A 4/1994 Liang et al.
5,311,958 A 5/1994 Isbell et al.
5,326,196 A 7/1994 Noll
5,333,520 A 8/1994 Fischer et al.
5,348,806 A 9/1994 Kojo et al.
5,359,772 A 11/1994 Carlsson et al.
5,373,907 A 12/1994 Weaver
5,376,329 A 12/1994 Morgan et al.
5,423,899 A 6/1995 Krall et al.
5,433,280 A 7/1995 Smith
5,438,858 A 8/1995 Friedrichs
5,443,337 A 8/1995 Katayama
5,452,771 A 9/1995 Blackman et al.
5,467,669 A 11/1995 Stroud
5,479,997 A 1/1996 Scott et al.
5,480,272 A 1/1996 Jorgensen et al.
5,482,670 A 1/1996 Hong
5,484,468 A 1/1996 Östlund et al.
5,487,626 A 1/1996 Von Holst et al.
5,496,137 A 3/1996 Ochayon et al.
5,505,748 A 4/1996 Tank et al.
5,506,055 A 4/1996 Dorfman et al.
5,518,077 A 5/1996 Blackman et al.
5,525,134 A 6/1996 Mehrotra et al.
5,541,006 A 7/1996 Conley
5,543,235 A 8/1996 Mirchandani et al.
5,544,550 A 8/1996 Smith
5,560,440 A 10/1996 Tibbitts
5,570,978 A 11/1996 Rees et al.
5,580,666 A 12/1996 Dubensky et al.
5,586,612 A 12/1996 Isbell et al.
5,590,729 A 1/1997 Cooley et al.
5,593,474 A 1/1997 Keshavan et al.
5,601,857 A 2/1997 Friedrichs
5,603,075 A 2/1997 Stoll et al.
5,609,447 A 3/1997 Britzke et al.
5,611,251 A 3/1997 Katayama
5,612,264 A 3/1997 Nilsson et al.
5,628,837 A 5/1997 Britzke et al.
RE35,538 E 6/1997 Akesson et al.

5,635,247 A 6/1997 Ruppi
5,641,251 A 6/1997 Leins et al.
5,641,921 A 6/1997 Dennis et al.
5,662,183 A 9/1997 Fang
5,665,431 A 9/1997 Narasimhan
5,666,864 A 9/1997 Tibbitts
5,677,042 A 10/1997 Massa et al.
5,679,445 A 10/1997 Massa et al.
5,686,119 A 11/1997 McNaughton, Jr.
5,697,042 A 12/1997 Massa et al.
5,697,046 A 12/1997 Conley
5,697,462 A 12/1997 Grimes et al.
5,718,948 A 2/1998 Ederyd et al.
5,732,783 A 3/1998 Truax et al.
5,733,649 A 3/1998 Kelley et al.
5,733,664 A 3/1998 Kelley et al.
5,750,247 A 5/1998 Bryant et al.
5,753,160 A 5/1998 Takeuchi et al.
5,755,033 A 5/1998 Gunter et al.
5,762,843 A 6/1998 Massa et al.
5,765,095 A 6/1998 Flak et al.
5,776,593 A 7/1998 Massa et al.
5,778,301 A 7/1998 Hong
5,789,686 A 8/1998 Massa et al.
5,792,403 A 8/1998 Massa et al.
5,806,934 A 9/1998 Massa et al.
5,830,256 A 11/1998 Northrop et al.
5,851,094 A 12/1998 Stand et al.
5,856,626 A 1/1999 Fischer et al.
5,863,640 A 1/1999 Ljungberg et al.
5,865,571 A 2/1999 Tankala et al.
5,873,684 A 2/1999 Flolo
5,880,382 A 3/1999 Fang et al.
5,890,852 A 4/1999 Gress
5,897,830 A 4/1999 Abkowitz et al.
5,947,660 A 9/1999 Karlsson et al.
5,957,006 A 9/1999 Smith
5,963,775 A 10/1999 Fang
5,964,555 A 10/1999 Strand
5,967,249 A 10/1999 Butcher
5,971,670 A 10/1999 Pantzar et al.
5,988,953 A 11/1999 Berglund et al.
6,007,909 A 12/1999 Rolander et al.
6,022,175 A 2/2000 Heinrich et al.
6,029,544 A 2/2000 Katayama
6,051,171 A 4/2000 Takeuchi et al.
6,063,333 A 5/2000 Dennis
6,068,070 A 5/2000 Scott
6,073,518 A 6/2000 Chow et al.
6,086,003 A 7/2000 Gunter et al.
6,086,980 A 7/2000 Foster et al.
6,089,123 A 7/2000 Chow et al.
6,148,936 A 11/2000 Evans et al.
6,200,514 B1 3/2001 Meister
6,209,420 B1 4/2001 Butcher et al.
6,214,134 B1 4/2001 Eylon et al.
6,214,287 B1 4/2001 Waldenström
6,217,992 B1 4/2001 Grab
6,220,117 B1 4/2001 Butcher
6,227,188 B1 5/2001 Tankala et al.
6,228,139 B1 5/2001 Oskarsson
6,241,036 B1 6/2001 Lovato et al.
6,248,277 B1 6/2001 Friedrichs
6,254,658 B1 7/2001 Taniuchi et al.
6,287,360 B1 9/2001 Kembaiyan et al.
6,290,438 B1 9/2001 Papajewski
6,293,986 B1 9/2001 Rödiger et al.
6,299,658 B1 10/2001 Moriguchi et al.
6,353,771 B1 3/2002 Southland
6,372,346 B1 4/2002 Toth
6,374,932 B1 4/2002 Brady
6,375,706 B2 4/2002 Kembaiyan et al.
6,386,954 B2 5/2002 Sawabe et al.
6,395,108 B2 5/2002 Eberle et al.
6,425,716 B1 7/2002 Cook
6,450,739 B1 9/2002 Puide et al.
6,453,899 B1 9/2002 Tselesin
6,454,025 B1 9/2002 Runquist et al.
6,454,028 B1 9/2002 Evans
6,454,030 B1 9/2002 Findley et al.
6,458,471 B2 10/2002 Lovato et al.
6,461,401 B1 10/2002 Kembaiyan et al.
6,474,425 B1 11/2002 Truax et al.
6,499,917 B1 12/2002 Parker et al.
6,499,920 B2 12/2002 Sawabe
6,500,226 B1 12/2002 Dennis
6,502,623 B1 1/2003 Schmitt
6,511,265 B1 1/2003 Mirchandani et al.
6,544,308 B2 4/2003 Griffin et al.
6,562,462 B2 5/2003 Griffin et al.
6,576,182 B1 6/2003 Ravagni et al.
6,585,064 B2 7/2003 Griffin et al.
6,589,640 B2 7/2003 Griffin et al.
6,599,467 B1 7/2003 Yamaguchi et al.
6,607,693 B1 8/2003 Saito et al.
6,620,375 B1 9/2003 Tank et al.
6,638,609 B2 10/2003 Nordgren et al.
6,655,481 B2 12/2003 Findley et al.
6,685,880 B2 2/2004 Engström et al.
6,688,988 B2 2/2004 McClure
6,695,551 B2 2/2004 Silver
6,706,327 B2 3/2004 Blomstedt et al.
6,719,074 B2 4/2004 Tsuda et al.
6,737,178 B2 5/2004 Ota et al.
6,742,608 B2 6/2004 Murdoch
6,742,611 B1 6/2004 Illerhaus et al.
6,756,009 B2 6/2004 Sim et al.
6,764,555 B2 7/2004 Hiramatsu et al.
6,766,870 B2 7/2004 Overstreet
6,808,821 B2 10/2004 Fujita et al.
6,844,085 B2 1/2005 Takayama et al.
6,848,521 B2 2/2005 Lockstedt et al.
6,849,231 B2 2/2005 Kojima et al.
6,892,793 B2 5/2005 Liu et al.
6,899,495 B2 5/2005 Hansson et al.
6,918,942 B2 7/2005 Hatta et al.
6,948,890 B2 9/2005 Svensson et al.
6,949,148 B2 9/2005 Sugiyama et al.
6,955,233 B2 10/2005 Crowe et al.
6,958,099 B2 10/2005 Nakamura et al.
7,014,719 B2 3/2006 Suzuki et al.
7,014,720 B2 3/2006 Iseda
7,044,243 B2 5/2006 Kembaiyan et al.
7,048,081 B2 5/2006 Smith et al.
7,070,666 B2 7/2006 Druschitz et al.
7,090,731 B2 8/2006 Kashima et al.
7,101,128 B2 9/2006 Hansson
7,101,446 B2 9/2006 Takeda et al.
7,112,143 B2 9/2006 Muller
7,125,207 B2 10/2006 Craig et al.
7,128,773 B2 10/2006 Liang et al.
7,147,413 B2 12/2006 Henderer et al.
7,207,750 B2 4/2007 Annanolli et al.
7,238,414 B2 7/2007 Benitsch et al.
7,244,519 B2 7/2007 Festeau et al.
7,250,069 B2 7/2007 Kembaiyan et al.
7,261,782 B2 8/2007 Hwang et al.
7,270,679 B2 9/2007 Istephanous et al.
7,381,283 B2 6/2008 Lee et al.
7,384,413 B2 6/2008 Gross et al.
7,384,443 B2 6/2008 Mirchandani
7,410,610 B2 8/2008 Woodfield et al.
7,497,396 B2 3/2009 Splinter et al.
7,513,320 B2 4/2009 Mirchandani et al.
7,625,157 B2 12/2009 Prichard et al.
7,687,156 B2 3/2010 Fang
7,846,551 B2 12/2010 Fang et al.
8,007,922 B2 8/2011 Mirchandani et al.
2002/0004105 A1 1/2002 Kunze et al.
2003/0010409 A1 1/2003 Kunze et al.
2003/0041922 A1 3/2003 Hirose et al.
2003/0219605 A1 11/2003 Molian et al.
2004/0013558 A1 1/2004 Kondoh et al.
2004/0105730 A1 6/2004 Nakajima
2004/0228695 A1 11/2004 Clauson
2004/0234820 A1 11/2004 Majagi
2004/0245022 A1 12/2004 Izaguirre et al.
2004/0245024 A1 12/2004 Kembaiyan

| | | | |
|---|---|---|---|
| 2005/0008524 | A1 | 1/2005 | Testani |
| 2005/0084407 | A1 | 4/2005 | Myrick |
| 2005/0103404 | A1 | 5/2005 | Hsieh et al. |
| 2005/0117984 | A1 | 6/2005 | Eason et al. |
| 2005/0194073 | A1 | 9/2005 | Hamano et al. |
| 2005/0211475 | A1 | 9/2005 | Mirchandani et al. |
| 2005/0247491 | A1 | 11/2005 | Mirchandani et al. |
| 2005/0268746 | A1 | 12/2005 | Abkowitz et al. |
| 2006/0016521 | A1 | 1/2006 | Hanusiak et al. |
| 2006/0032677 | A1 | 2/2006 | Azar et al. |
| 2006/0043648 | A1 | 3/2006 | Takeuchi et al. |
| 2006/0060392 | A1 | 3/2006 | Eyre |
| 2006/0286410 | A1 | 12/2006 | Ahlgren et al. |
| 2006/0288820 | A1 | 12/2006 | Mirchandani et al. |
| 2007/0082229 | A1 | 4/2007 | Mirchandani et al. |
| 2007/0102198 | A1 | 5/2007 | Oxford et al. |
| 2007/0102199 | A1 | 5/2007 | Smith et al. |
| 2007/0102200 | A1 | 5/2007 | Choe et al. |
| 2007/0102202 | A1 | 5/2007 | Choe et al. |
| 2007/0108650 | A1 | 5/2007 | Mirchandani et al. |
| 2007/0126334 | A1 | 6/2007 | Nakamura et al. |
| 2007/0163679 | A1 | 7/2007 | Fujisawa et al. |
| 2007/0193782 | A1 | 8/2007 | Fang et al. |
| 2007/0251732 | A1 | 11/2007 | Mirchandani et al. |
| 2008/0011519 | A1 | 1/2008 | Smith et al. |
| 2008/0101977 | A1 | 5/2008 | Eason et al. |
| 2008/0163723 | A1 | 7/2008 | Mirchandani et al. |
| 2008/0302576 | A1 | 12/2008 | Mirchandani et al. |
| 2009/0041612 | A1 | 2/2009 | Fang et al. |
| 2009/0136308 | A1 | 5/2009 | Newitt |
| 2009/0180915 | A1 | 7/2009 | Mirchandani et al. |
| 2009/0290849 | A1 | 11/2009 | Ohtake et al. |
| 2009/0293672 | A1 | 12/2009 | Mirchandani et al. |
| 2010/0044114 | A1 | 2/2010 | Mirchandani et al. |
| 2010/0044115 | A1 | 2/2010 | Mirchandani et al. |
| 2010/0290849 | A1 | 11/2010 | Mirchandani et al. |
| 2011/0011965 | A1 | 1/2011 | Mirchandani et al. |

FOREIGN PATENT DOCUMENTS

| | | | |
|---|---|---|---|
| CA | 2212197 | C | 10/2000 |
| EP | 0157625 | A2 | 10/1985 |
| EP | 0264674 | A2 | 4/1988 |
| EP | 0453428 | A1 | 10/1991 |
| EP | 0641620 | B1 | 2/1998 |
| EP | 0995876 | A2 | 4/2000 |
| EP | 1065021 | A1 | 1/2001 |
| EP | 1077763 | B1 | 2/2001 |
| EP | 1106706 | A1 | 6/2001 |
| EP | 0759480 | B1 | 1/2002 |
| EP | 1244531 | B1 | 10/2004 |
| EP | 1686193 | A2 | 8/2006 |
| FR | 2627541 | A2 | 8/1989 |
| GB | 622041 | | 4/1949 |
| GB | 945227 | | 12/1963 |
| GB | 1062568 | | 9/1967 |
| GB | 1309634 | | 3/1973 |
| GB | 1420906 | | 1/1976 |
| GB | 1491044 | | 11/1977 |
| GB | 2158744 | A | 11/1985 |
| GB | 2218931 | A | 11/1989 |
| GB | 2324752 | A | 11/1998 |
| GB | 2352727 | A | 2/2001 |
| GB | 2385350 | A | 8/2003 |
| GB | 2393449 | A | 3/2004 |
| GB | 2397832 | A | 8/2004 |
| GB | 2435476 | A | 8/2007 |
| JP | 51-124876 | A | 10/1976 |
| JP | 59-175912 | A | 10/1984 |
| JP | 60-172403 | A | 9/1985 |
| JP | 61-243103 | A | 10/1986 |
| JP | 62-063005 | A | 3/1987 |
| JP | 2-269515 | A | 11/1990 |
| JP | 5-50314 | A | 3/1993 |
| JP | H03-119090 | U | 6/1995 |
| JP | 8-120308 | A | 5/1996 |
| JP | H8-209284 | | 8/1996 |
| JP | 10219385 | A | 8/1998 |
| JP | 11-300516 | A | 11/1999 |
| JP | 2002-097885 | A | 4/2002 |
| JP | 02254144 | A | 9/2002 |
| JP | 2002-317596 | A | 10/2002 |
| JP | 2003-306736 | A | 10/2003 |
| JP | 2004-181604 | | 7/2004 |
| JP | 2004-190034 | A | 7/2004 |
| JP | 2005-111581 | A | 4/2005 |
| RU | 2135328 | C1 | 8/1999 |
| SU | 1292917 | A1 | 2/1987 |
| SU | 1350322 | | 11/1987 |
| WO | WO 92/05009 | A1 | 4/1992 |
| WO | WO 92/22390 | A1 | 12/1992 |
| WO | WO 98/26455 | A1 | 7/1998 |
| WO | WO 99/13121 | A1 | 3/1999 |
| WO | WO 00/43628 | A2 | 7/2000 |
| WO | WO 00/52217 | A1 | 9/2000 |
| WO | WO 01/43899 | A1 | 6/2001 |
| WO | WO 03/010350 | A1 | 2/2003 |
| WO | WO 03/011508 | A2 | 2/2003 |
| WO | WO 03/049889 | A2 | 6/2003 |
| WO | WO 2004/053197 | A2 | 6/2004 |
| WO | WO 2005/045082 | A2 | 5/2005 |
| WO | WO 2005/054530 | A1 | 6/2005 |
| WO | WO 2005/061746 | A1 | 7/2005 |
| WO | WO 2005/106183 | A1 | 11/2005 |
| WO | WO 2006/071192 | A1 | 7/2006 |
| WO | WO 2006/104004 | A1 | 10/2006 |
| WO | WO 2007/001870 | A2 | 1/2007 |
| WO | WO 2007/022336 | A2 | 2/2007 |
| WO | WO 2007/030707 | A1 | 3/2007 |
| WO | WO 2007/044791 | A1 | 4/2007 |
| WO | WO 2007/127680 | A1 | 11/2007 |
| WO | WO 2008/098636 | A1 | 8/2008 |
| WO | WO 2008/115703 | A1 | 9/2008 |
| WO | WO 2011/008439 | A2 | 1/2011 |

OTHER PUBLICATIONS

Deng, X. et al., "Mechanical Properties of a Hybrid Cemented Carbide Composite," International Journal of Refractory Metals and Hard Materials, Elsevier Science Ltd., vol. 19, 2001, pp. 547-552.

Gurland, Joseph, "Application of Quantitative Microscopy to Cemented Carbides," Practivcal Applications of Quantitaive Matellography, ASTM Special Technical Publication 839, ASTM 1984, pp. 65-84.

Hayden, Matthew and Lyndon Scott Stephens, "Experimental Results for a Heat-Sink Mechanical Seal," Tribology Transactions, 48, 2005, pp. 352-361.

Metal Handbook, vol. 16 Machining, "Cemented Carbides" (ASM International 1989), pp. 71-89.

Metals Handbook, vol. 16 Machining, "Tapping" (ASM International 1989), pp. 255-267.

Peterman, Walter, "Heat-Sink Compound Protects the Unprotected," Welding Design anf Fabrication, Sep. 2003, pp. 20-22.

Shi et al., "Composite Ductility—The Role of Reinforcement and Matrix", TMS Meeting, Los Vegas, NV, Feb. 12-16, 1995, 10 pages.

Sriram, et al., "Effect of Carium Addition on Microstructures of Carbon-Alloyed Iron Aluminides," Bull. Mater. Sci., vol. 28, No. 6, Oct. 2005, pp. 547-554.

Tracey et al., "Development of Tungsten Carbide-Cobalt-Ruthenium Cutting Tools for Machining Steels" Proccedings Annual Microprogramming Workshop, vol. 14, 1981, pp. 281-292.

Underwood, *Quantitative Stereology*, pp. 23-108 (1970).

Vander Vort, "Introduction to Quantitative Metallography", Tech Notes, vol. 1, Issue 5, published by Buehler, Ltd. 1997, 6 pages.

J. Gurland, *Quantitative Microscopy*, R.T. DeHoff and F.N. Rhines, eds., McGraw-Hill Book Company, New York, 1968, pp. 279-290.

You Tube, "The Story Behind Kennametal's Beyond Blast", dated Sep. 14, 2010, http://www.youtube.com/watch?v=8_A-bYVwmU8 (3 pages) accessed on Oct. 14, 2010.

Kennametal press release on Jun. 10, 2010, http://news.thomasnet.com/companystory/Kennametal-Launches-Beyond-BLAST-TM-at-IMTS-2010-Booth-W-1522-833445 (2 pages) accessed on Oct. 14, 2010.

Pages form Kennametal site, http://www.kennametal.com/en-US/promotions/Beyond_Blast.jhtml (7 pages) accessed on Oct. 14, 2010.

ASM Materials Engineering Dictionary, J.R. Davis, Ed., ASM International, Fifth printing, Jan. 2006, p. 98.
Childs et al., "Metal Machining", 2000, Elsevier, p. 111.
Brookes, Kenneth J. A., "World Directory and Handbook of Hardmetals and Hard Materials", International Carbide Data, U.K. 1996, Sixth Edition, p. 42.
Firth Sterling grade chart, Allegheny Technologies, attached to Declaration of Prakash Mirchandani, Ph.D. as filed in U.S. Appl. No. 11/737,993 on Sep. 9, 2009.
Metals Handbook Desk Edition, definition of 'wear', 2nd. Ed., J.R. Davis, Editor, ASM International 1998, p. 62.
McGraw-Hill Dictionary of Scientific and Technical Terms, 5th Edition, Sybil P. Parker, Editor in Chief, 1993, pp. 799, 800, 1933 and 2047.
ProKon Version 8.6, The Calculation Companion, Properties for W, Ti, Mo, Co, Ni and FE, Copyright 1997-1998, 6 pages.
Tibtech Innovations, "Properties table of stainless steel, metals and other conductive materials", printed from http://www.tibtech.com/conductivity.php on Aug. 19, 2011, 1 page.
"Material: Tungsten Carbide (WC), bulk", MEMSnet. printed from http://www.memsnet.org/material/tungstencarbidewcbulk/ on Aug. 19, 2001, 1 page.
Office Action mailed Jun. 1, 2001 in U.S. Appl. No. 09/460,540.
Office Action mailed Dec. 1, 2001 in U.S. Appl. No. 09/460,540.
Office Action mailed Mar. 15, 2002 in U.S. Appl. No. 09/460,540.
Office Action mailed Jun. 18, 2002 in U.S. Appl. No. 09/460,540.
Notice of Allowance mailed Oct. 21, 2002 in U.S. Appl. No. 09/460,540.
Office Action mailed Mar. 12, 2009 in U.S. Appl. No. 11/585,408.
Office Action mailed Sep. 22, 2009 in U.S. Appl. No. 11/585,408.
Office Action mailed Sep. 7, 2010 in U.S. Appl. No. 11/585,408.
Office Action mailed Feb. 16, 2011 in U.S. Appl. No. 11/585,408.
Advisory Action mailed May 3, 2011 in U.S. Appl. No. 11/585,408.
Office Action mailed Aug. 17, 2011 in U.S. Appl. No. 11/585,408.
Office Action mailed Jan. 16, 2007 in U.S. Appl. No. 11/013,842.
Office Action mailed Jul. 16, 2008 in U.S. Appl. No. 11/013,842.
Office Action mailed Jul. 30, 2007 in U.S. Appl. No. 11/013,842.
Notice of Allowance mailed Nov. 26, 2008 in U.S. Appl. No. 11/013,842.
Restriction Requirement mailed Jul. 24, 2008 in U.S. Appl. No. 11/167,811.
Office Action mailed Oct. 21, 2008 in U.S. Appl. No. 11/167,811.
Final Office Action mailed Jun. 12, 2009 in U.S. Appl. No. 11/167,811.
Office Action mailed Aug. 28, 2009 in U.S. Appl. No. 11/167,811.
Office Action mailed Mar. 2, 2010 in U.S. Appl. No. 11/167,811.
Office Action mailed Aug. 19, 2010 in U.S. Appl. No. 11/167,811.
Advisory Action Before the Filing of an Appeal Brief mailed May 12, 2010 in U.S. Appl. No. 11/167,811.
Office Action mailed Feb. 3, 2011 in U.S. Appl. No. 11/167,811.
Advisory Action malied May 11, 2011 in U.S. Appl. No. 11/167/811.
Office Action mailed Jul. 22, 2011 in U.S. Appl. No. 11/167,811.
Office Action mailed Oct. 13, 2006 in U.S. Appl. No. 10/922,750.
Notice of Allowance mailed May 21, 2007 in U.S. Appl. No. 10/922,750.
Supplemental Notice of Allowability mailed Jul. 3, 2007, for U.S. App. No. 10/922,750.
Office Action mailed Mar. 19, 2009 in U.S. Appl. No. 11/737,993.
Office Action mailed Jun. 3, 2009 in U.S. Appl. No. 11/737,993.
Office Action mailed Dec. 9, 2009 in U.S. Appl. No. 11/737,993.
Office Action mailed Feb. 24, 2010 in U.S. Appl. No. 11/737,993.
Office Action mailed Jun. 29, 2010 in U.S. Appl. No. 11/737,993.
Advisory Action Before the Filing of an Appeal Brief mailed Sep. 9, 2010 in U.S. Appl. No. 11/737,993.
Pre-Brief Appeal Conference Decision mailed Nov. 22, 2010 in U.S. Appl. No. 11/737,993.
Office Action mailed Apr. 20, 2011 in U.S. Appl. No. 11/737,993.
Office Action mailed Aug. 3, 2011 in U.S. Appl. No. 11/737,993.
Restriction Requirement mailed Sep. 17, 2010 in U.S. Appl. No. 12/397,597.
Office Action mailed Nov. 15, 2010 in U.S. Appl. No. 12/397,597.
Office Action mailed Jun. 7, 2011 in U.S. Appl. No. 12/397,597.
Advisory Action Before the Filing of an Appeal Brief mailed Aug. 31, 2011 in U.S. Appl. No. 12/397,597.
Office Action mailed May 3, 2010 in U.S. Appl. No. 11/924,273.
Office Action mailed Oct. 14, 2010 in U.S. Appl. No. 11/924,273.
Office Action mailed Feb. 2, 2011 in U.S. Appl. No. 11/924,273.
Office Action mailed May 14, 2009 in U.S. Appl. No. 11/687,343.
Office Action mailed Jan. 21, 2010 in U.S. Appl. No. 11/687,343.
Notice of Allowance mailed May 18, 2010 in U.S. Appl. No. 11/687,343.
Office Action mailed Dec. 29, 2005 in U.S. Appl. No. 10/903,198.
Office Action mailed Sep. 29, 2006 in U.S. Appl. No. 10/903,198.
Office Action mailed Mar. 27, 2007 in U.S. Appl. No. 10/903,198.
Office Action mailed Sep. 26, 2007 in U.S. Appl. No. 10/903,198.
Office Action mailed Jan. 16, 2008 in U.S. Appl. No. 10/903,198.
Office Action mailed Oct. 31, 2008 in U.S. Appl. No. 10/903,198.
Office Action mailed Apr. 17, 2009 in U.S. Appl. No. 10/903,198.
Advisory Action before mailing of Appeal Brief mailed Jun. 29, 2009 in U.S. Appl. No. 10/903,198.
Examiner's Answer mailed Aug. 17, 2010 in U.S. Appl. No. 10/903,198.
Office Action mailed Apr. 22, 2010 in U.S. Appl. No. 12/196,951.
Office Action mailed Oct. 29, 2010 in U.S. Appl. No. 12/196,951.
Office Action mailed Apr. 12, 2011 in U.S. Appl. No. 12/196,951.
Restriction Requirement mailed Aug. 4, 2010 in U.S. Appl. No. 12/196,815.
Office Action mailed Oct. 27, 2010 in U.S. Appl. No. 12/196,815.
Office Action mailed Nov. 17, 2010 in U.S. Appl. No. 12/196,815.
Notice of Allowance mailed Jan. 27, 2011 in U.S. Appl. No. 12/196,815.
Notice of Allowance mailed May 16, 2011 in U.S. Appl. No. 12/196,815.
Office Action mailed Aug. 31, 2007 in U.S. Appl. No. 11/206,368.
Office Action mailed Feb. 28, 2008 in U.S. Appl. No. 11/206,368.
Pre-Appeal Conference Decision mailed Jun. 19, 2008 in Appiication No, 111206,368.
Notice of Allowance mailed Nov. 13, 2008 in U.S. Appl. No. 11/206,368.
Office Action mailed Apr. 30, 2009 in U.S. Appl. No. 11/206,368.
Notice of Allowance mailed Nov. 30, 2009 in U.S. Appl. No. 11/206,368.
Office Action mailed Aug. 29, 2011 in U.S. Appl. No. 12/476,738.
U.S. Appl. No. 13/207,478, filed Aug. 11, 2011.
US 4,966,627, 10/1990, Keshavan et al. (withdrawn)

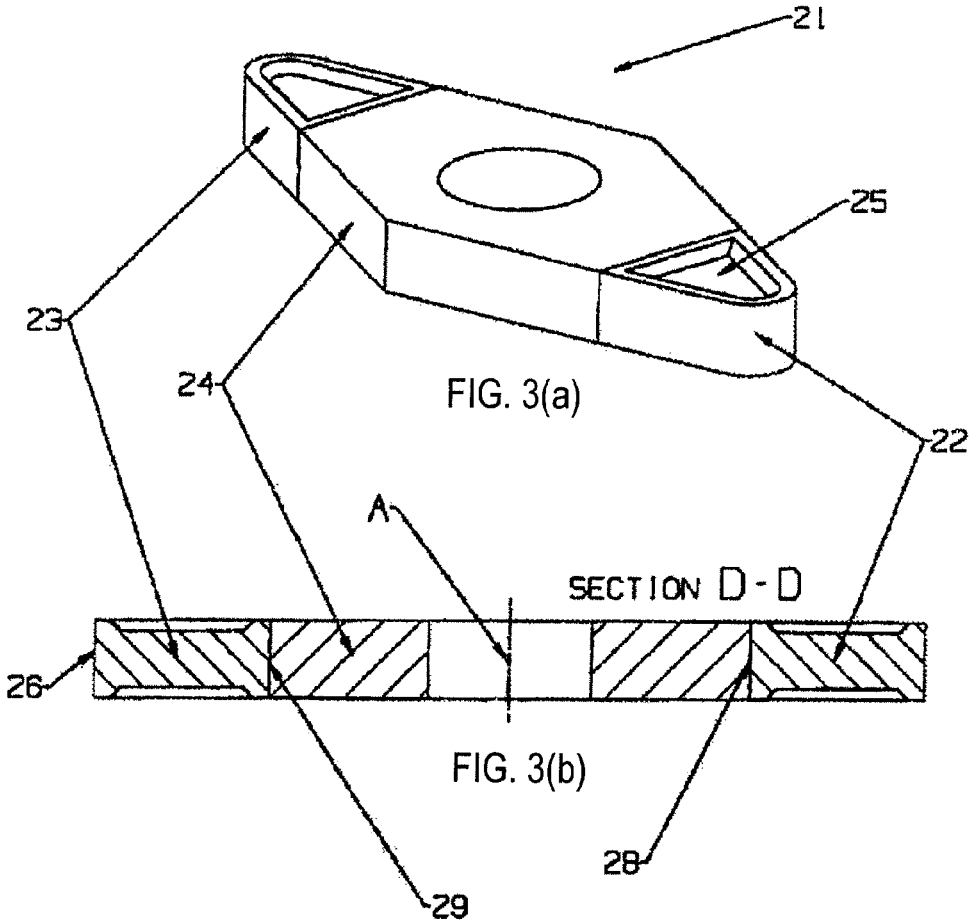
FIG. 3(a)
FIG. 3(b)
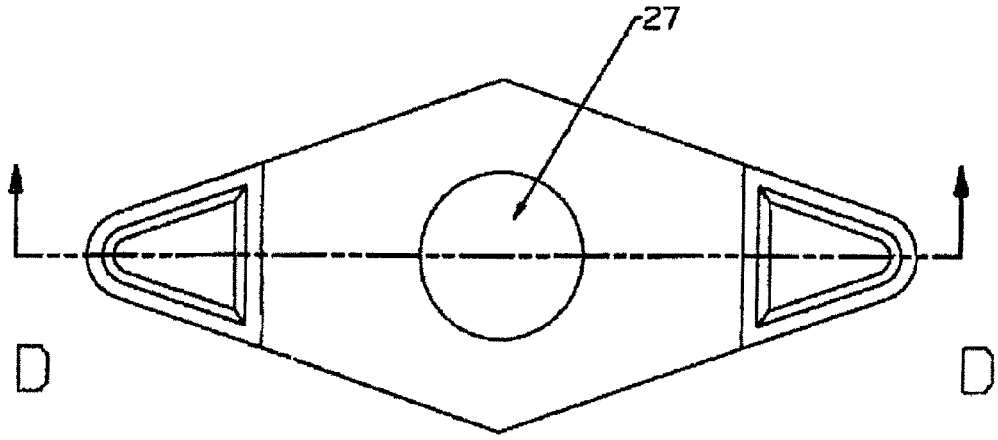
FIG. 3(c)

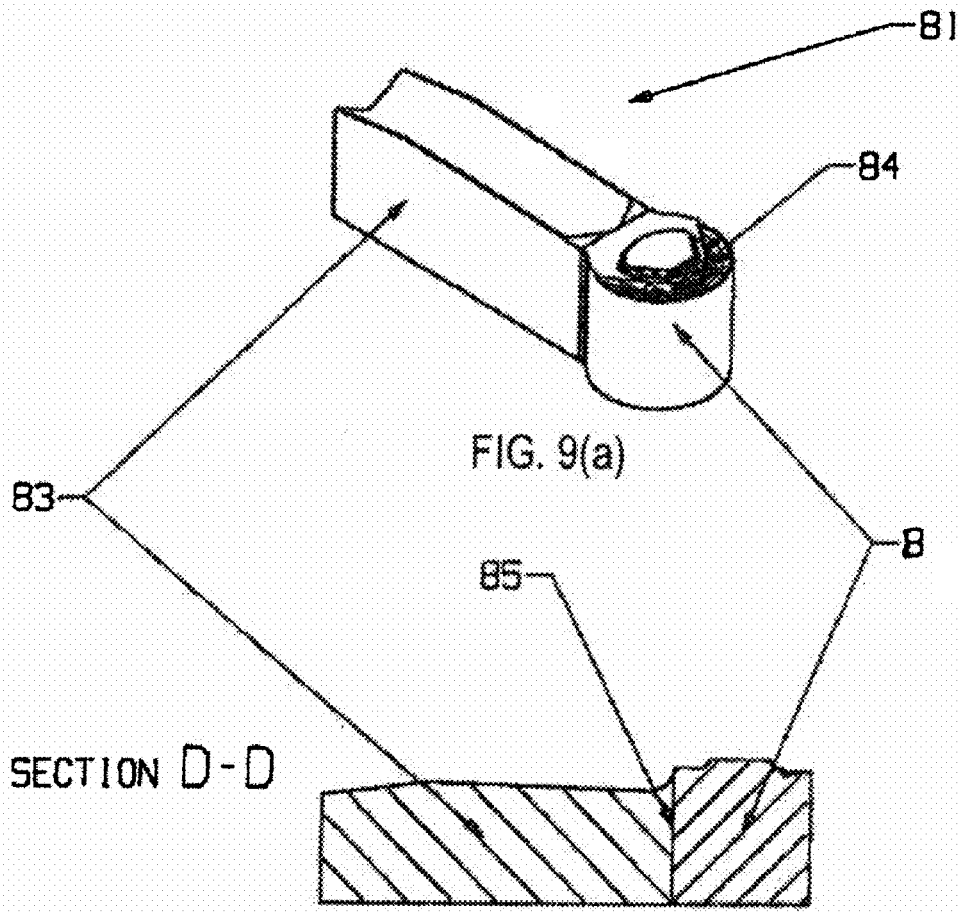
FIG. 9(a)
FIG. 9(b)
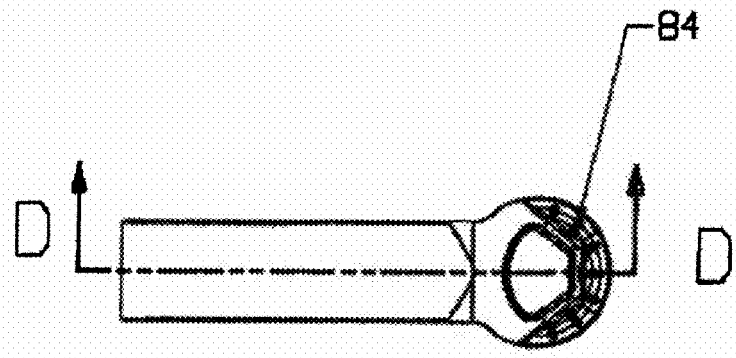
FIG. 9(c)

COMPOSITE ARTICLES

CROSS-REFERENCE TO RELATED APPLICATIONS

This application is a continuation application of, and claims priority under 35 U.S.C. §120 to, co-pending U.S. patent application Ser. No. 11/687,343, filed Mar. 16, 2007, which is incorporated by reference.

TECHNICAL FIELD

The present invention is generally directed to composite articles, such as, for example, tool blanks, cutting tool inserts, spade drill inserts, and ballnose endmills, having a composite construction including regions of differing composite materials.

Certain non-limiting embodiments of a composite article according to the present disclosure comprise at least a first composite material and a second composite material, wherein each of the first and second composite materials individually comprises hard particles in a binder, and wherein the concentration of ruthenium in the binder of the first composite material is different from the concentration of ruthenium in the binder of the second composite material. Also, in certain non-limiting embodiments of a composite article according to the present disclosure, one of the first and second composite materials comprises ruthenium in the binder and the other of the first and second composite materials lacks ruthenium or comprises no more than an incidental concentration of ruthenium in the binder. Examples of composite articles according to the present disclosure include, but are not limited to, cemented carbide tools used in material removal operations such as, for example, turning, milling, threading, grooving, drilling, reaming, countersinking, counterboring, and end milling.

BACKGROUND

Cutting tool inserts employed for machining of metals and metallic (i.e., metal-containing) alloys are commonly fabricated from composite materials. Composite materials provide an attractive combination of mechanical properties, such as strength, toughness, and wear resistance, compared to certain other tool materials, such as tool steels and ceramics. Conventional cutting tool inserts made from a composite material, such as cemented carbide, are based on a "monolithic" construction, which means that they are fabricated from a single grade of cemented carbide. As such, conventional monolithic cutting tools have substantially the same mechanical and chemical properties at all locations throughout the tool.

Cemented carbide materials or, more simply, "carbide materials" or "carbides", comprise at least two phases: at least one hard particulate ceramic component; and a softer matrix of metallic binder. The hard ceramic component may be, for example, carbides of any carbide-forming element, such as, for example, titanium, chromium, vanadium, zirconium, hafnium, molybdenum, tantalum, tungsten, and niobium. A common, non-limiting example is tungsten carbide. The binder may be a metal or metallic alloy, typically cobalt, nickel, iron, or alloys of any of these metals. The binder "cements" the ceramic component within a continuous matrix interconnected in three dimensions. As is known in the art, cemented carbides may be fabricated by consolidating a powder including at least one powdered ceramic component and at least one powdered metallic binder material.

The physical and chemical properties of cemented carbides depend in part on the individual components of the metallurgical powders used to produce the materials. The properties of a particular cemented carbide are determined by, for example, the chemical composition of the ceramic component, the particle size of the ceramic component, the chemical composition of the binder, and the weight or volume ratio of binder to ceramic component. By varying the ingredients of the metallurgical powder, cutting tools, such as cutting tool inserts, including indexable inserts, drills and end mills can be produced with unique properties matched to specific cutting applications.

In applications involving the machining of modern metallic materials, enriched grades of carbide are often utilized to achieve the desired quality and productivity requirements. However, cutting tool inserts having a monolithic carbide construction composed of higher grades of cemented carbides are expensive to fabricate, primarily due to high material costs. In addition, it is difficult to optimize the composition of conventional monolithic indexable cutting inserts composed of single grades of carbide material to meet the differing demands placed on the various regions of the inserts.

Composite rotary tools made of two or more different carbide materials or grades are described in U.S. Pat. No. 6,511,265. At this time, composite carbide cutting tool inserts are more difficult to manufacture than rotary cutting tools. For example, cutting inserts are, typically, much smaller than rotary cutting tools. Also, the geometries, in particular, cutting edges and chip breaker configurations, of current cutting tool inserts are complex in nature. With cutting tool inserts, the final product is produced by a pressing and sintering process, and the process also may include subsequent grinding operations.

U.S. Pat. No. 4,389,952, which issued in 1983, describes an innovative method of making composite cemented carbide tools by first manufacturing a slurry containing a mixture of carbide powder and a liquid vehicle, and then painting or spraying a surface layer of the mixture onto a green compact of a different carbide. A composite carbide tool made in this way has distinct mechanical properties differing between the core region and the surface layer. The described applications of this method include fabricating rock drilling tools, mining tools and indexable cutting tool inserts for metal machining. However, the slurry-based method described in the '952 patent can only be applied to making indexable cutting inserts without chip breaker geometries or, at best, with very simple chip breaker geometries. This is because a thick layer of slurry will alter the insert's chip breaker geometry. Widely used indexable cutting inserts, in particular, must have intricate chip breaker geometries in order to meet the ever-increasing demands for machining a variety of work materials. In addition, performing the slurry-based method of producing composite tools and inserts requires a substantially greater investment in specialized manufacturing operations and production equipment.

Ruthenium (Ru) is a member of the platinum group and is a hard, lustrous, white metal that has a melting point of approximately 2,500° C. Ruthenium does not tarnish at room temperatures, and may be used as an effective hardener, creating alloys that are extremely wear resistant. It has been found that including ruthenium in a cobalt binder in cemented carbide used in cutting tools or cutting tool inserts improves resistance to thermal cracking and significantly reduces crack propagation along the edges and into the body of the cutting tool or cutting tool insert. Typical commercially available cutting tools and cutting tool inserts may include a cemented carbide substrate having a binder phase including approximately 3% to 30% ruthenium. A significant disadvantage of adding ruthenium, however, is that it is a relatively expensive alloying ingredient.

A cutting tool insert including a cemented carbide substrate may comprise one or more coating layers on the substrate surface to enhance cutting performance. Methods for coating cemented carbide cutting tools include chemical vapor deposition (CVD), physical vapor deposition (PVD) and diamond coating.

There is a need to develop improved efficient, low cost cutting tool inserts for metal and metallic alloy machining applications.

SUMMARY

According to one aspect of the present disclosure, a composite article is provided including a first composite material and a second composite material. The first composite material and the second composite material individually comprise hard particles in a binder, and a concentration of ruthenium in the binder of the first composite material is different from a concentration of ruthenium in the binder of the second composite material.

In certain non-limiting embodiments of a composite article according to the present disclosure, the binder of the first composite material includes 1 to 30 weight percent, 3 to 25 weight percent, or 8 to 20 weight percent ruthenium. Also, in certain non-limiting embodiments of a composite article according to the present disclosure, the binder of the second composite material lacks ruthenium or includes only an incidental concentration of ruthenium. In addition, according to certain non-limiting embodiments of a composite article according to the present disclosure, the concentration of ruthenium in the binder of the first composite material and the concentration of ruthenium in the binder of the second composite material differ by at least 1 weight percent, at least 5 weight percent, or at least 10 weight percent.

In certain non-limiting embodiments, the composite article according to the present disclosure is one of a cutting tool and a cutting tool insert. For example, embodiments of the composite article according to the present disclosure may be selected from a ballnose end mill, a ballnose cutting insert, a milling cutting insert, a spade drill insert, a drilling insert, a turning cutting insert, a grooving insert, a threading insert, a cut-off insert, and a boring insert.

Unless otherwise indicated, all numbers expressing quantities of ingredients, time, temperatures, and so forth used in the present specification and claims are to be understood as being modified in all instances by the term "about." At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, may inherently contain certain errors necessarily resulting from the standard deviation found in their respective testing measurements.

The reader will appreciate the foregoing details and advantages of the present invention, as well as others, upon consideration of the following detailed description of certain non-limiting embodiments of the invention. The reader also may comprehend such additional details and advantages of the present invention upon making and/or using embodiments within the present invention.

BRIEF DESCRIPTION OF THE FIGURES

FIGS. 3*a* through 3*c* depict an embodiment of a diamond-shaped indexable cutting tool insert according to the present disclosure, comprising three regions of composite materials.

FIGS. 9*a* through 9*c* depict an embodiment of a groove or cut-off cutting insert according to the present disclosure, comprising three regions of composite materials.

DESCRIPTION OF VARIOUS NON-LIMITING EMBODIMENTS

Figure 1A:
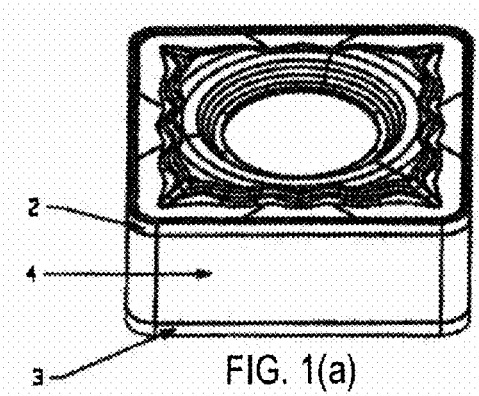
FIGS. 1*a* through 1*d* depict an embodiment of a square indexable cutting tool insert according to the present disclosure, comprising three regions of composite materials.

The present disclosure describes unique composite articles such as, for example, composite cutting tool inserts, rotary cutting tool inserts, drilling inserts, milling inserts, spade drills, spade drill inserts, and ballnose inserts. Embodiments of the composite articles according to the present disclosure include a first composite material and a second composite material. In certain embodiments according to the present disclosure, each composite material individually comprises hard particles in a binder, and the concentration of ruthenium in the binder of the first composite material is different from the concentration of ruthenium in the binder of the second composite material. In certain non-limiting embodiments, composite articles according to the present disclosure comprise a first composite material including ruthenium in the binder, and a second composite material including a binder that either does not comprise ruthenium or comprises no more than an incidental concentration of ruthenium in the binder.

The composite articles according to the present disclosure present may be contrasted with the subject matter of U.S. Pat. No. 6,511,265, which issued in January 2003 and relates to composite carbide rotary tools, and pending U.S. patent application Ser. No. 11/206,368, which relates to methods for manufacturing composite carbide cutting inserts. Certain composite articles according to the present disclosure differ from the subject matter of the '265 patent and '368 application for at least the reason that the present disclosure describes unique composite structures including at least a first and second composite materials, wherein each composite material individually comprises hard particles in a binder and the concentration of ruthenium in the binder of the first composite material is different from the concentration of ruthenium in the binder of the second composite material.

Including ruthenium in the binder phase of cemented carbides has been found to provide improved resistance to thermal cracking in cutting tools and cutting tool inserts during machining operations, reduced propagation of cracks along and beyond the cutting edges, reduced propagation of cracks into the substrate, as well as other benefits. Cemented hard particles in a binder wherein the binder comprises ruthenium are referred to herein as "ruthenium featured carbides". Ruthenium may be present in any quantity effective to have a beneficial effect on the properties of the cutting tool, cutting tool insert, or other article. Examples of useful concentrations of ruthenium in the binder include, for example, from 1% to 30%, by weight based on the total weight of the binder. In certain embodiments, the concentration of ruthenium in the binder may be from 3% to 25% by weight; or from 8% to 20% by weight, all based on the total weight of the binder.

Although adding ruthenium can provide significant benefits, as noted above, it is an expensive alloying constituent. In that regard, certain non-limiting embodiments of composite articles, such as, for example, cutting tools and cutting tool inserts, according to the present disclosure may include ruthenium in the binder of only those regions of the article that can benefit from the advantages that the presence of ruthenium provides in cutting operations. The concentration of ruthenium in other regions of the article, regions that would not significantly benefit from the presence of ruthenium in the binder of those regions, may be zero, or may be reduced relative to other regions. Accordingly, for example, the present disclosure comprehends a composite article including different regions of cemented carbides having varying levels of ruthenium in the regions' binders. Ruthenium preferably is included in relatively high concentrations in the binder of regions of the article that will benefit from the improved properties afforded by the presence of ruthenium in such regions. Ruthenium preferably is absent, is present only in incidental amounts, or is present in relatively low concentrations in the binder of regions of the article that will not significantly benefit from the improved properties afforded by the presence of ruthenium in such regions.

In certain non-limiting embodiments of the composite articles according to the present disclosure, the ruthenium concentration of the binder of the first composite material and the ruthenium concentration of the binder of the second composite material differ by at least 1 weight percent, at least 5 weight percent, or at least 10 weight percent, wherein such differences are determined by subtracting the lower ruthenium concentration from the higher ruthenium concentration. Certain embodiments of composite cutting tools and cutting tool inserts fabricated with regions having varying binder concentrations of ruthenium, for example, can reduce the usage of ruthenium by 40% to 90% (by weight) relative to monolithic articles, wherein the concentration of ruthenium is uniform throughout the article. Thus, constructing composite articles, such as cutting tools and cutting tool inserts, according to the present disclosure can significantly reduce the cost to produce such articles, and without sacrificing desired cutting properties.

Embodiments of composite articles according to the present disclosure, for example, composite inserts, may include chip forming geometries on one or both of the articles' top and bottom surfaces. The chip forming geometry of the composite article may be, for example, a complex chip forming geometry. A complex chip forming geometry may be any geometry that has various configurations on the tool rake face, such as lumps, bumps, ridges, grooves, lands, backwalls, or combinations of two or more such features.

As used herein, "composite article" or "composite cutting tool" refers to an article or cutting tool having discrete regions of composite materials differing in one or more characteristics selected from physical properties, chemical properties, chemical composition, and microstructure. For purposes of this definition, a coating applied to an article, cutting tool, or cutting tool insert is not considered to alone constitute a "region". Also, as used herein, a "composite material" is a material that includes two or more substantially homogenously distributed phases. An example of a composite material is a cemented carbide, which includes a particulate ceramic material in a binder. In certain embodiments according to the present disclosure, a first region of composite material includes ruthenium in the binder (a "ruthenium featured composite material"); and a second region of composite material does not comprise ruthenium (a "non-ruthenium featured composite material"). In certain embodiments of composite articles according to the present disclosure, the characteristic that differs between the discrete regions is at least one of hardness, tensile strength, wear resistance, fracture toughness, modulus of elasticity, corrosion resistance, coefficient of thermal expansion, and coefficient of thermal conductivity.

Composite inserts that may be constructed as provided in the present disclosure include, for example, inserts for turning, threading, grooving, milling, slot milling, end milling, face milling, drilling, reaming, countersinking, counterboring, and tapping of materials. There may be boundaries between the regions of such articles that differ in one or more characteristics. The boundaries between the regions, however, typically are not clear, discrete, planar boundaries due to the nature of the manufacturing process and the powdered metals. During powder addition into a die or mold in certain methods that may be used to form composite articles according to the present disclosure, for example, there may be some mixing of the powdered metal grades near the regions of interface between the grades. Therefore, as used herein, reference to "boundaries" or a "boundary" between two regions of composite materials refers to a general boundary region between the two regions, wherein the two regions constitute predominantly one or the other composite material. Further, during sintering of pre-sintered compacts comprising two or more regions, there may be some diffusion of materials between the regions.

Certain non-limiting embodiments according to the present disclosure are directed to composite articles, such as, for example, composite cutting tool inserts, including at least one cutting edge and at least two regions of composite materials that differ with respect to at least one characteristic. Certain embodiments of composite inserts according to the present disclosure may be indexable and/or comprise chip forming geometries. The differing characteristics of the two or more regions of composite material result from at least a difference in ruthenium concentration in binder phases included in the two regions, but also may be a result of variation in other characteristics of the regions such as variations in chemical composition (in addition to ruthenium concentration) and microstructure. The chemical composition of a particular region is a function of, for example, the chemical composition of the ceramic component and/or binder of the region, and the carbide-to-binder ratio of the region.

Composite articles according to the present disclosure may be produced by any known method of producing composite materials. Examples of such methods include the method of producing a composite article described in U.S. patent application Ser. No. 11/206,368, which is hereby incorporated herein by reference in its entirety.

Examples of the first and second composite materials included in articles according to the present disclosure may individually comprise hard particles in a binder. The hard particles in each of the composite materials may independently comprise, for example, at least one of a carbide, a nitride, a boride, a silicide, an oxide, and a solid solution of two more of these, and the binder material may comprise, for example, at least one of cobalt, nickel, iron, and alloys of these metals. In certain non-limiting embodiments, the hard particles may comprise a metal carbide, wherein the metal of the metal carbide is selected from any carbide forming element, such as, for example, titanium, chromium, vanadium, zirconium, hafnium, molybdenum, tantalum, tungsten, and niobium. Also, in certain non-limiting embodiments, the metal carbide of the first composite material differs from the metal carbide of the second composite material in at least one of chemical composition and average grain size. The binder material of the first composite material and the binder of the second composite material may each individually comprise, for example, one or more of cobalt, cobalt alloy, nickel, nickel alloy, iron, and iron alloy. In certain embodiments, the first composite material and the second composite material may individually comprise from 2 to 40 weight percent of the binder and from 60 to 98 weight percent of a metal carbide, based on the total weight of the material. The binder of the first carbide grade and the binder of the second carbide grade may differ in the concentration of ruthenium in the binder and may also differ in other aspects, such as chemical composition, weight percentage of binder in the carbide material, metal grade, or both. In some embodiments, the first material includes ruthenium in a concentration that is from 1 to 10, or from 5 to 20, weight percent more than the concentration of ruthenium in the second material. The two of more powdered cemented carbide grades in a particular article according to the present disclosure may comprise ruthenium in the binder, but in embodiments comprising multiple regions of ruthenium featured composite materials, the concentration of ruthenium in the binder of one region may be different from the ruthenium concentration in a different region, but may be substantially similar to the concentration of ruthenium in any other region.

A necessarily limited number of examples of composite articles according to the present disclosure are provided below. It will be apparent to one skilled in the art that the following discussion of embodiments according to the present disclosure may be adapted to the fabrication of composite inserts having complex geometries and/or more than two regions of composite materials. For example, certain embodiments of the composite articles according to the present disclosure may have 3, 4, 5, 6, or more regions of composite material, wherein each region differs from at least one other region in the article in at least one characteristic. The following discussion of certain embodiments is not intended to restrict the invention, but merely to illustrate certain possible embodiments.

Embodiments of composite articles according to the present disclosure, such as embodiments of cutting tool inserts, may be produced at lower cost than conventional articles. Cost savings may be obtained by providing ruthenium in regions of the article that will benefit from the presence of ruthenium when the article is in use, while eliminating or limiting the concentration of ruthenium in other regions wherein the benefits of ruthenium may not be exploited to significant advantage when the article is in use. Another advantage of certain embodiments of composite articles, such as certain composite cutting tool inserts, according to the present disclosure is the flexibility available to the tool designer to tailor characteristics of different regions of the composite articles to adapt the articles to specific cutting applications. For example, the size, location, thickness, geometry, and/or physical properties of an individual cemented carbide material in one region of a cutting insert according to the present disclosure may be selected to suit a specific machining application.

As used herein, a "core region" of a composite article in the form of a cutting tool insert refers to a portion of the insert generally including the center of the insert. As used herein, a "core region" of a composite article in the form of a drill insert refers to a core portion including the cutting edge subjected to the lowest cutting speeds, which typically is the cutting edge that is closest to the axis of rotation. As used herein, a "surface region" of a cutting tool insert includes all or a portion of the surface of the insert. As used herein, a "surface region" of a drill insert includes the surface of the cutting edge subjected to the higher cutting speeds, which typically is a cutting edge that is relatively far from the axis of rotation. In certain insert embodiments, the core region includes a portion of the surface of the insert.

Certain non-limiting embodiments of composite inserts according to the present disclosure may have a surface region of a carbide material comprising ruthenium in the binder to provide the surface region with improved wear resistance, and a core region of a relatively tougher carbide material to increase shock or impact resistance of the core region. In such embodiments, the core regions may or may not include a binder comprising ruthenium, and if ruthenium is present in the core region the concentration of ruthenium in the binder of the core region is different from the concentration of ruthenium in the surface region. In this way, characteristics of different regions of an insert according to the present disclosure may be optimized to address the conditions to which the regions are subjected during use of the insert to machine materials. Therefore, for example, composite indexable carbide cutting tool inserts made according to the present disclosure may be designed to achieve the objectives of reduced manufacturing cost (through a reduction in overall ruthenium content relative to monolithic inserts) and improved machining performance (by tailoring one or more characteristics of core and surface regions, for example).

Certain embodiments of cutting tools and cutting tool inserts according to the present disclosure may comprise a coating applied by, for example, PVD and/or CVD methods. Embodiments of coatings may include, for example, at least one of a metal carbide, a metal nitride, a metal boride, and a metal oxide of a metal selected from groups IIIA, IVB, VB, and VIB of the periodic table. More specific non-limiting examples of coatings that may be included on, for example, cutting tools and cutting tool inserts according to the present disclosure include hafnium carbon nitride and, for example, may also comprise one or more of titanium nitride (TiN), titanium carbonitride (TiCN), titanium carbide (TiC), titanium aluminum nitride (TiAlN), titanium aluminum nitride plus carbon (TiAlN+C), aluminum titanium nitride (AlTiN), aluminum titanium nitride plus carbon (AlTiN+C), titanium aluminum nitride plus tungsten carbide/carbon (TiAlN+WC/C), aluminum titanium nitride (AlTiN), aluminum titanium nitride plus carbon (AlTiN+C), aluminum titanium nitride plus tungsten carbide/carbon (AlTiN+WC/C), aluminum oxide ($Al_2O_3$), α-alumina oxide, titanium diboride ($TiB_2$), tungsten carbide carbon (WC/C), chromium nitride (CrN), aluminum chromium nitride (AlCrN), hafnium carbon nitride (HfCN), zirconium nitride (ZrN), zirconium carbon nitride (ZrCN), boron nitride (BN), and boron carbon nitride (BCN).

Figure 1B:
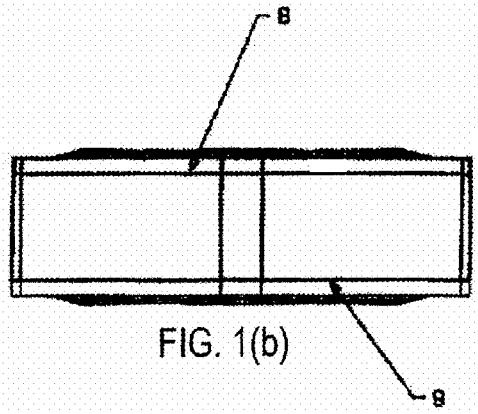
Figure 1C:
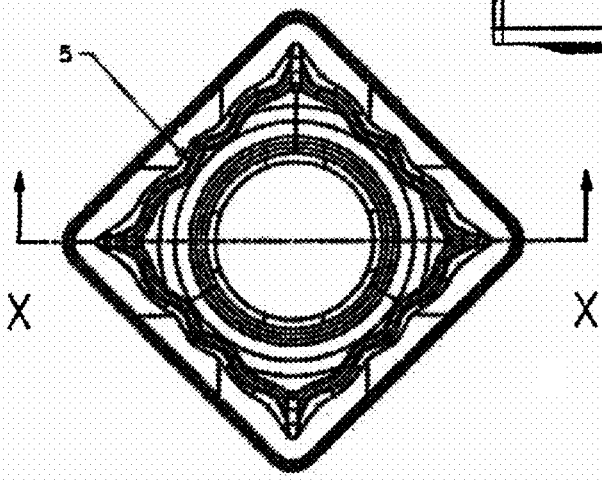
Figure 1D:
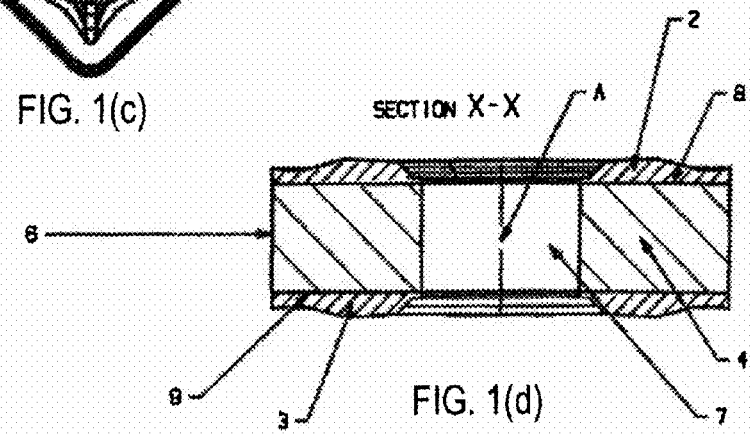

An example of one embodiment of a cutting tool insert according to the present disclosure is shown in FIGS. 1*a* through 1*d*. Cutting tool insert 1 has eight indexable positions (four on each side). FIG. 1*a* is a three-dimensional view of an embodiment of a cutting tool insert 1. The top region 2 and the bottom region 3 individually comprise cemented carbides including ruthenium in the binder of each region. The cemented carbides of regions 2 and 3 may be the same or different. The middle region 4 is a cemented carbide material that is a different grade than the cemented carbide material in top region 2 and bottom region 3 and includes binder either lacking or including a relatively low concentration of ruthenium. The cutting tool insert 1 has a built-in or pressed-in chip breaker geometry 5 that may be designed to improve machining of a specific group of materials under certain cutting conditions. FIG. 1*b* is a front view of cutting tool insert 1; FIG. 1*c* is a top view of cutting tool insert 1; and FIG. 1*d* is a cross-sectional view of cutting tool insert 1. Cutting tool insert 1 is a type of insert having a straight side wall 6 and a center hole 7. The center hole 7 may be used to fix the cutting tool insert 1 in a cutting tool holder. Regions 2, 3, and 4 are shown to have boundaries 8 and 9 that are generally perpendicular to the center axis A of center hole 7. However, such regions may have any geometry desired by the cutting tool designer. In producing cutting tool insert 1, the top and bottom punches of a carbide pressing apparatus may move together in a direction substantially parallel to center axis A.

Figure 2A:
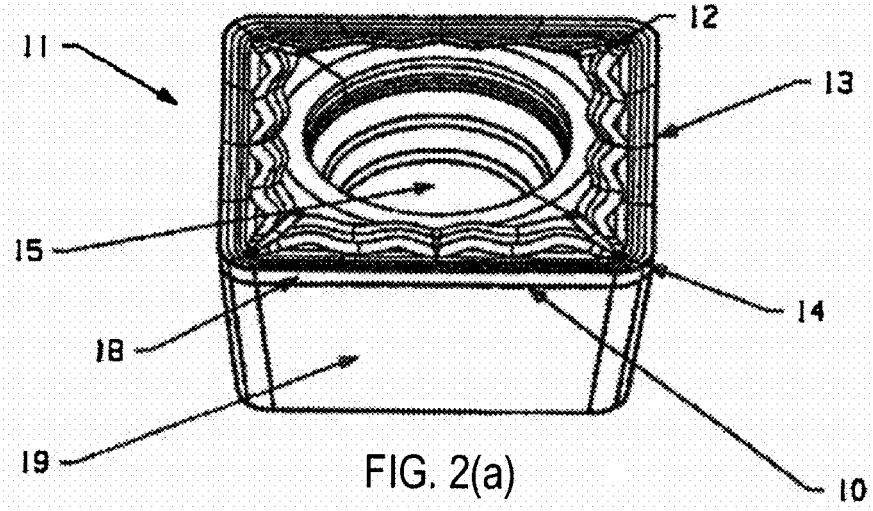
FIGS. 2*a* through 2*c* depict an embodiment of a square indexable cutting tool insert according to the present disclosure, comprising two regions of composite materials.
Figure 2B:
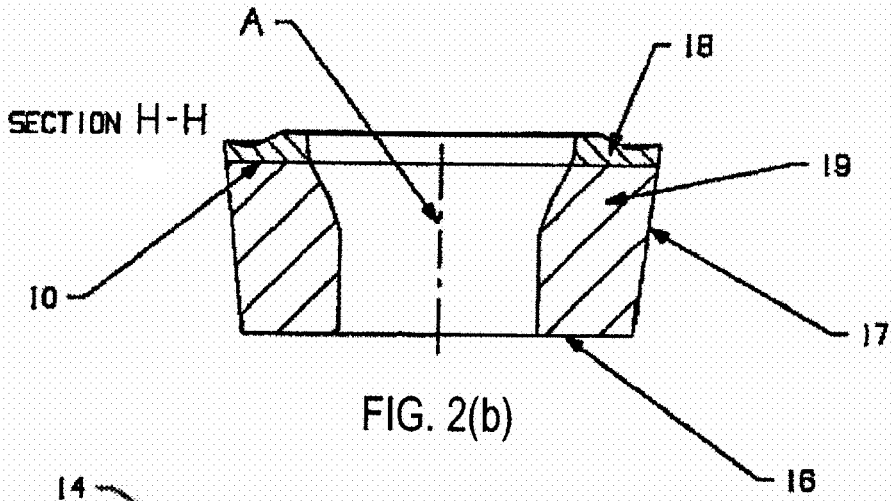
Figure 2C:
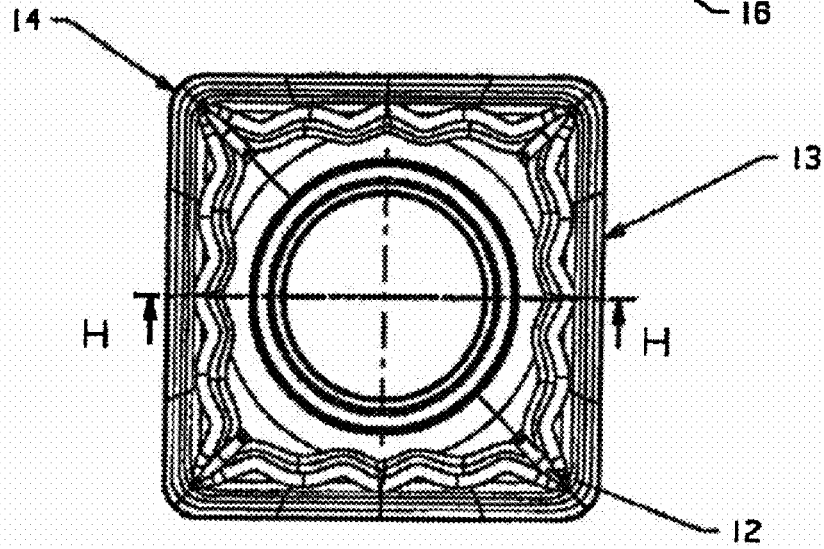

FIGS. 2*a* through 2*c* illustrate a composite indexable cutting tool insert 11 according to the present disclosure having a square shape with built-in chip breakers 12 on the top side, four cutting edges 13, four round cutting edges 14, and a center hole 15. The cutting insert 11 may be indexed four times. FIG. 2*a* is a three-dimensional view of cutting tool insert 11 in which top region 18 includes a first carbide grade, bottom region 19 includes a second carbide grade, and wherein the first carbide grade and the second carbide grade differ in concentration of ruthenium in their respective binders. The built-in or pressed-in chip breaker geometry 12 is designed to improve machining for a specific group of materials under certain cutting conditions. FIG. 2*b* is a cross-sectional view of cutting tool insert 11, and FIG. 2*c* is a top view of cutting tool insert 11. Such cutting tool inserts may have an angled side wall 17. Regions 18 and 19 are shown to have a common boundary 10 that is generally perpendicular to the central axis A of center hole 15. However, such regions may have any geometry desired by the cutting tool designer.

Embodiments of composite carbide indexable cutting tool inserts are not limited to cutting tool inserts 1 and 11 shown in FIGS. 1*a-d* and 2*a-c*. In the following FIGS. 3*a* through 5*d*, additional non-limiting examples of possible composite cemented carbide cutting inserts according to the present disclosure are shown. Any of the embodiments according to the present disclosure shown herein may comprise different composite materials in different regions.

FIGS. 3*a* through 3*c* depict aspects of a composite indexable cutting tool insert 21 with built-in chip breakers 25 on both the top and bottom sides. The cutting tool insert 21 has a diamond shape and can be indexed four times (two times on each side). FIG. 3*a* is a perspective view of insert 21 wherein one entire corner region 22 and another entire corner region 23 comprises a cemented carbide material including ruthenium in the binder, and a center region 24 comprises a second cemented carbide material having no ruthenium or a substantially lower concentration of ruthenium in the binder. Cutting tool insert 21 has a built-in or pressed-in chip breaker geometry 25 that is designed to machine a specific group of metallic materials under certain cutting conditions. FIG. 3*b* is the cross-sectional view of cutting insert 21; and FIG. 3*c* is a top view of cutting insert 21. This type of cutting insert has a straight side wall 26 and a center hole 27. There are two boundaries 28 and 29, which may be described as substantially parallel to axial line A of the center hole 27, between center region 24 and corner regions 23 and 25.

Figure 4A:
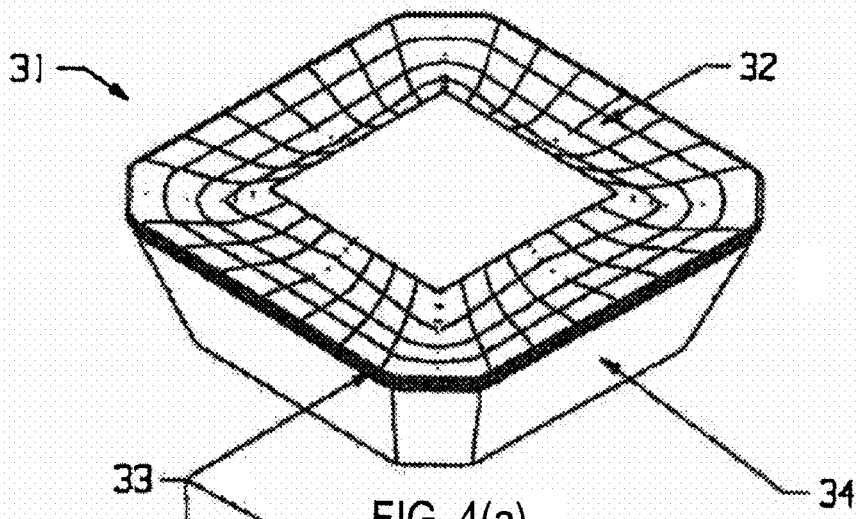
FIGS. 4*a* through 4*c* depict an embodiment of a square indexable cutting tool insert according to the present disclosure, comprising two regions of composite materials.
Figure 4B:
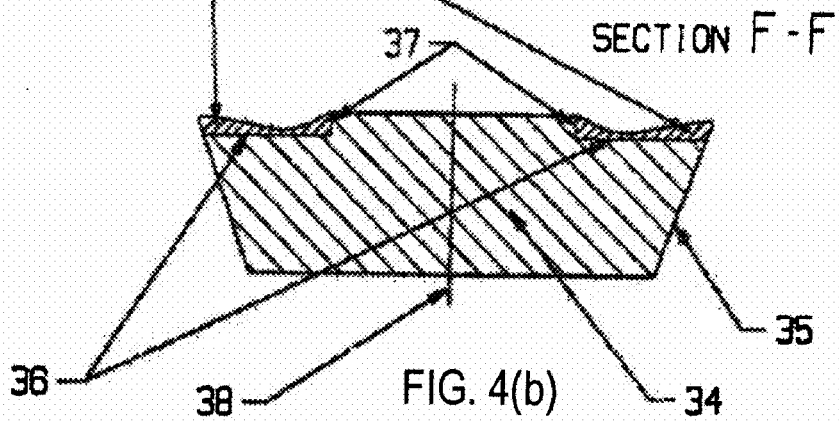
Figure 4C:
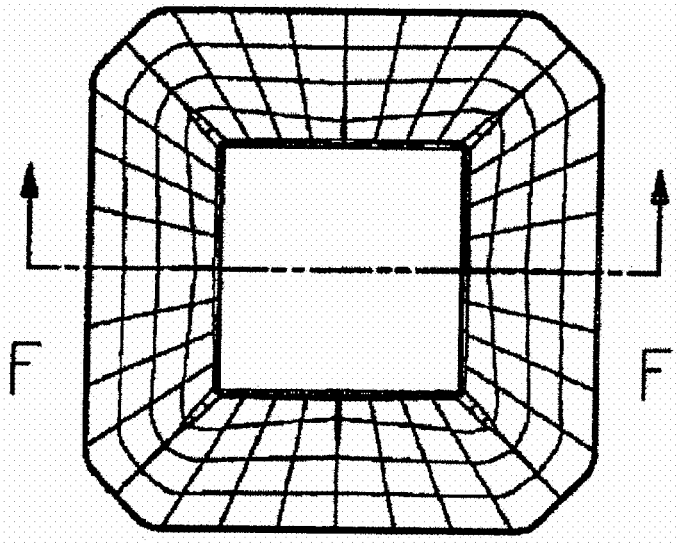

A further embodiment of a cutting tool insert according to the present disclosure is shown in FIGS. 4*a* through 4*c*. Composite indexable cutting insert 31 does not have a center hole, but does include built-in chip breakers 32 on a top surface thereof. The cutting tool insert 31 may be indexed four times. FIG. 4*a* is a perspective view of cutting insert 31. The partial top region 33 near the periphery comprises a first composite material comprising ruthenium in the binder. The remainder of the cutting insert body region 34 (from the top center portion to entire bottom region) contains a second composite material without ruthenium in the binder. FIG. 4*b* is a front view of the cutting tool insert 31, and FIG. 4*c* is a top view of the cutting tool insert 31. This type of cutting insert may have an angled side wall 35. The boundary 36 in this embodiment is substantially perpendicular to axial line 38, and the boundary 37 is substantially parallel to axial line 38.

Figure 5A:
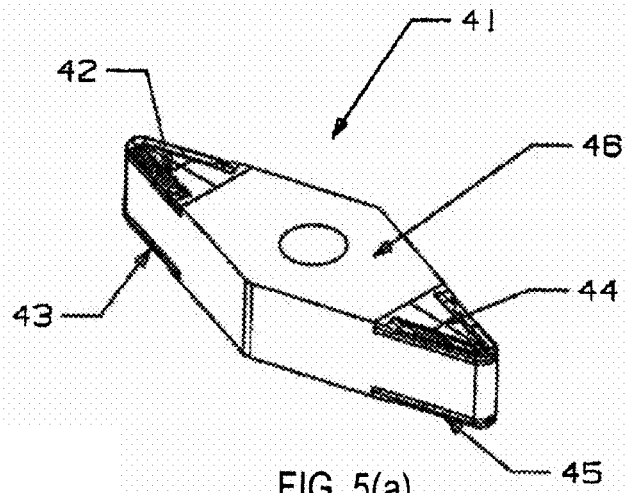
FIGS. 5*a* through 5*d* depict an embodiment of a diamond-shaped indexable cutting tool insert according to the present disclosure, comprising five regions of composite materials.
Figure 5B:
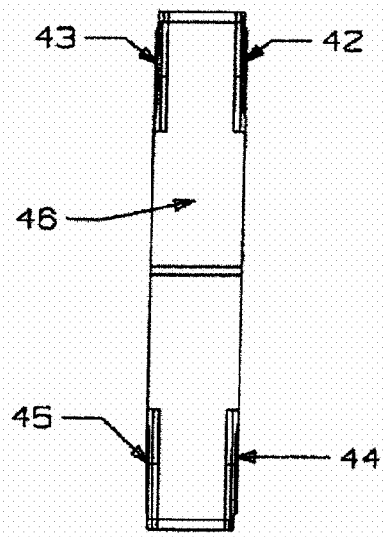
Figure 5C:
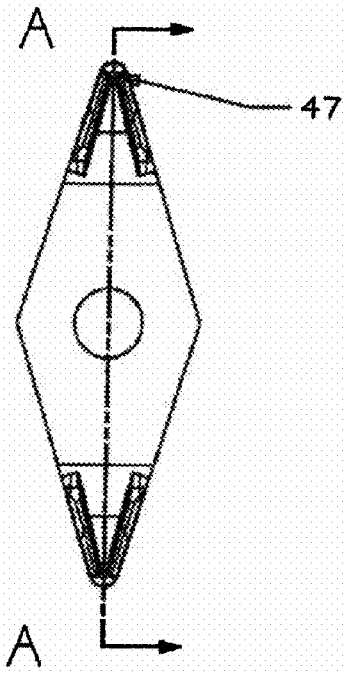
Figure 5D:
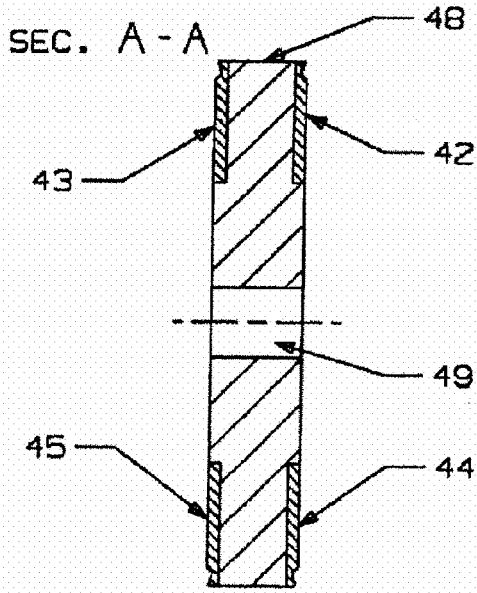

FIGS. 5*a* through 5*d* depict a further embodiment of a composite indexable cutting tool insert according to the present disclosure, with built-in chip breakers on both top and bottom sides. The cutting insert 41 has a diamond shape and may be indexed four times (two times on each side). As shown in FIG. 5*a*, the cutting insert may include a substantially identical ruthenium featured carbide composite material at cutting portions at the four corner regions 42, 43, 44 and 45, and a second carbide composite material having a different concentration of ruthenium in the binder in the body region 46. The cutting tool insert 41 has a built-in or pressed-in chip breaker geometry 47 that may be designed to machine a specific group of materials under certain cutting conditions. FIG. 5*b* is a front view of cutting insert 41; FIG. 5*c* is a top view of cutting tool insert 41; and FIG. 5*d* is a cross-sectional view of cutting tool insert 41. Cutting tool insert 41 has a straight side wall 48 and a center hole 49.

It should be emphasized that the shape of indexable cutting tool inserts according to the present disclosure may be any positive or negative geometrical style known to those of ordinary skill, and optionally may include any desired chip forming geometry. FIGS. 6*a* through 9*c* provide further non-limiting examples of different geometric shapes of cutting tool inserts that may be produced according to the present disclosure.

Figure 6A:
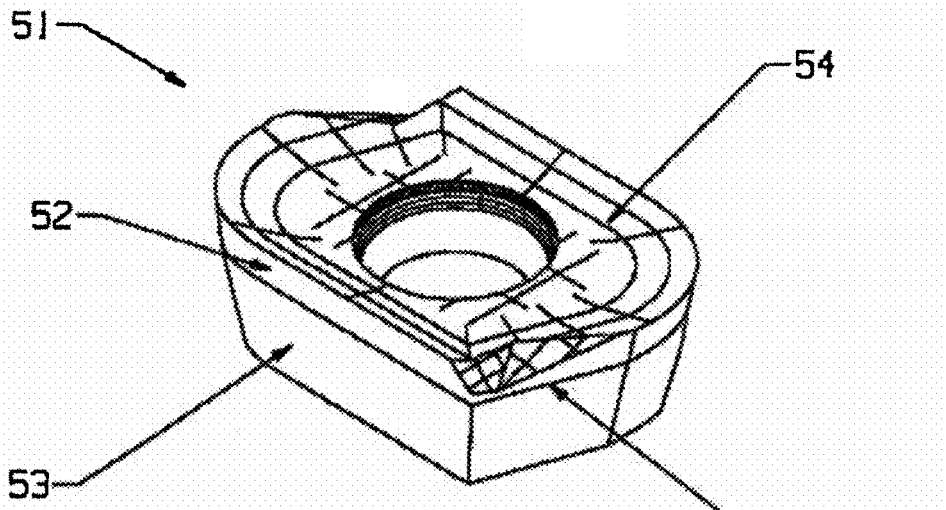
FIGS. 6*a* through 6*c* depict an embodiment of an indexable cutting tool insert according to the present disclosure, comprising two regions of composite materials.
Figure 6B:
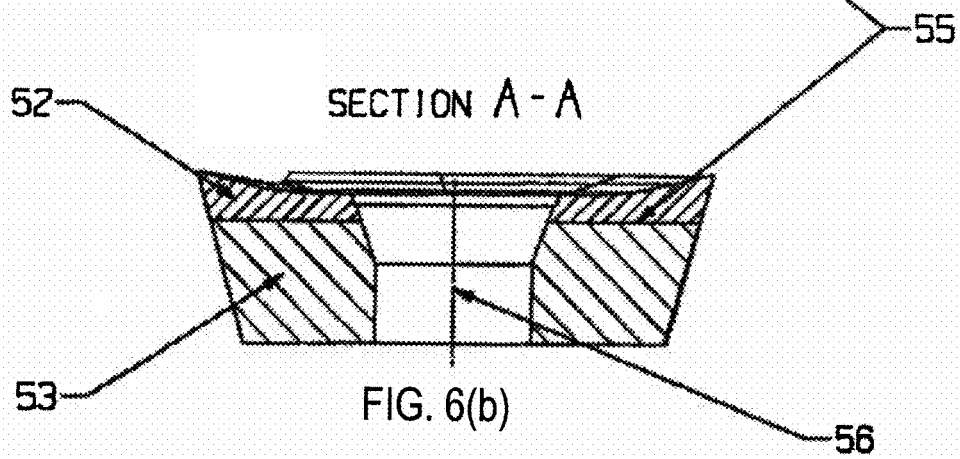
Figure 6C:
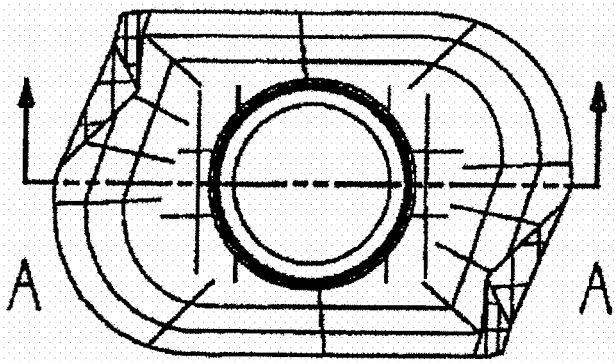

FIGS. 6*a* through 6*c* show an irregular-shaped milling insert 51 according to the present disclosure including two different composite materials: a ruthenium featured carbide material 52, and a non-ruthenium featured carbide material 53. The cutting tool insert 51 has a built-in or pressed-in chip breaker geometry 54. The boundary 55 between the ruthenium featured carbide material 52 and the non-ruthenium featured carbide material 53 is generally perpendicular to the axis 56 of pressing of the powder grades when forming the insert 51.

Figure 7A:
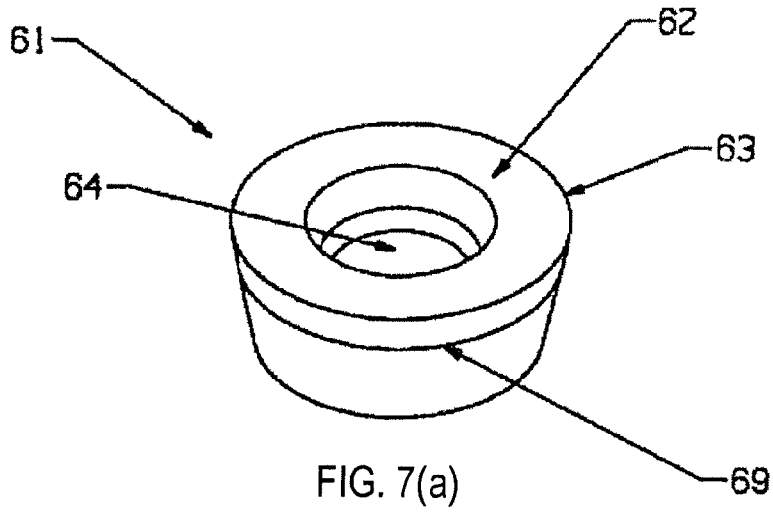
FIGS. 7*a* through 7*c* depict an embodiment of a round-shaped indexable cutting insert according to the present disclosure, comprising two regions of composite materials.
Figure 7B:
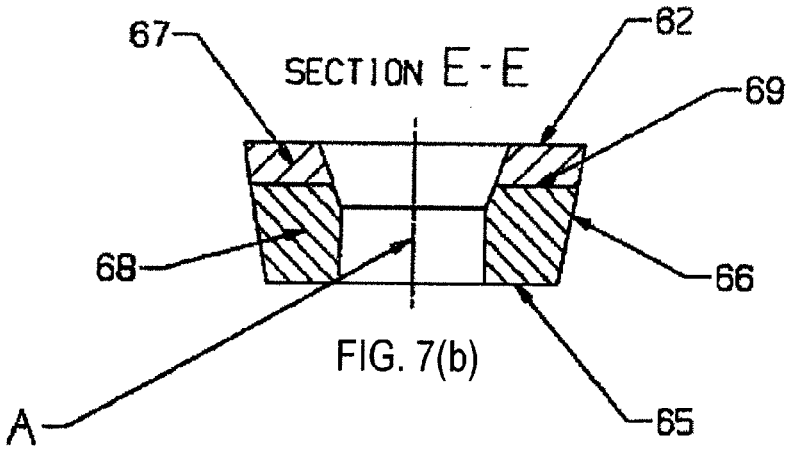
Figure 7C:
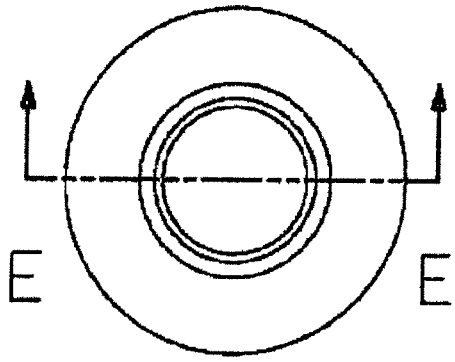

FIGS. 7*a* through 7*c* illustrate a round shape general purpose cutting tool insert 61 with two different carbide materials 67 and 68. The cutting insert 61 has a flat top surface 62. FIG. 7*b* is a cross-sectional view of cutting insert 61 taken at section E-E of the top view shown in FIG. 7*c*. Cutting insert 61 additionally comprises a bottom face 65 and angled side wall 66. The general boundary 69 is between the ruthenium featured carbide material 67 and the non-ruthenium featured carbide material 68. The consistency of the boundary 69 is dependent on the manufacturing process and is not critical to the invention. However, the boundary 69 is generally perpendicular to the axis A of pressing of the powdered materials during fabrication of the insert 61 by press-and-sinter techniques.

Figure 8A:
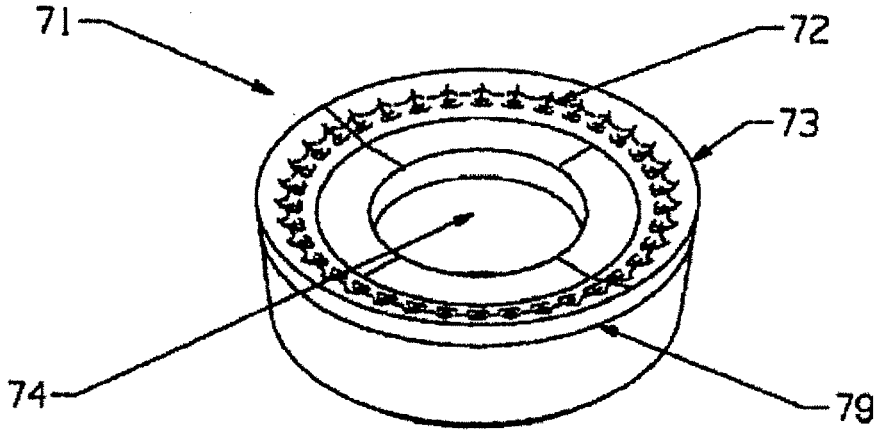
FIGS. 8*a* through 8*c* depict an embodiment of a round-shaped indexable cutting tool insert according to the present disclosure, comprising two regions of composite materials.
Figure 8B:
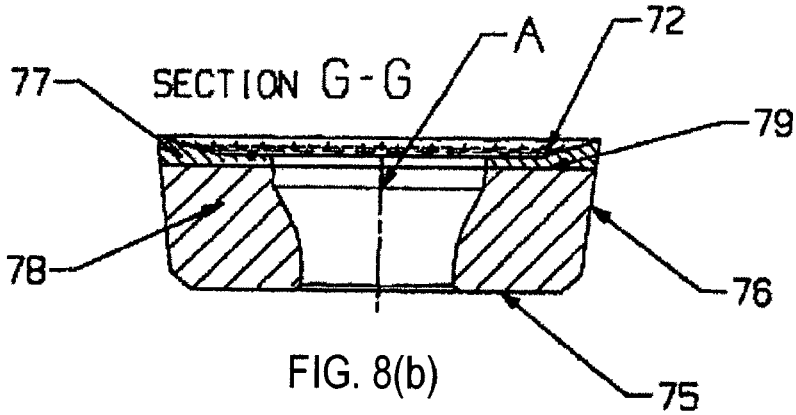
Figure 8C:
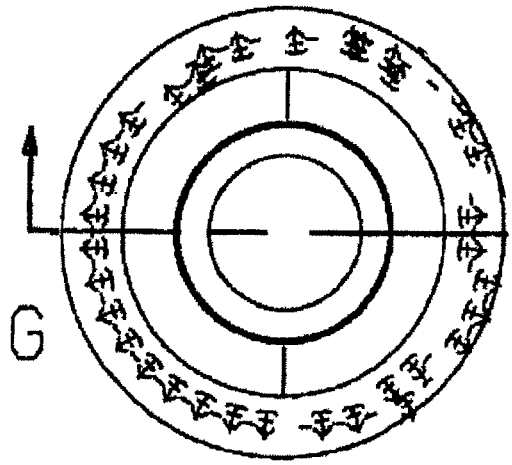

FIGS. 8*a* through 8*c* show a round shape general purpose cutting tool insert 71 according to the present disclosure, with two regions 77 and 78. The cutting insert 71 has a built-in or pressed-in chip breaker geometry 72, cutting edge 73, center hole 74, bottom face 75, and angled wall 76. Region 77 comprises a ruthenium featured carbide material, and region 78 comprises a non-ruthenium featured carbide material. Boundary 79 is shown perpendicular to axial line A. it will be understood, however, there may not be a clear and consistent boundary between regions 77 and 78 due to, for example, mixing and/or diffusion at boundary 79.

FIGS. 9*a* through 9*c* show a composite grooving or cut-off cutting tool insert 81 according to the present disclosure including a ruthenium featured carbide 82 and a non-ruthenium featured carbide 83. The cutting tool insert 81 has a built-in or pressed-in chip breaker geometry 84. Boundary 85 is between the ruthenium featured carbide and non-ruthenium featured carbide material. In this embodiment, the boundary 85 is in the same direction as the movement of the top and bottom punches used in a carbide power pressing technique.

Embodiments of composite constructions according to the present disclosure may include relatively complex composite constructions comprising multiple boundaries between regions of different cemented carbide materials. Certain of the boundaries may be substantially perpendicular to the axial line of pressing of the article, while other boundaries may be substantially parallel to the pressing axial line.

Figure 10A:
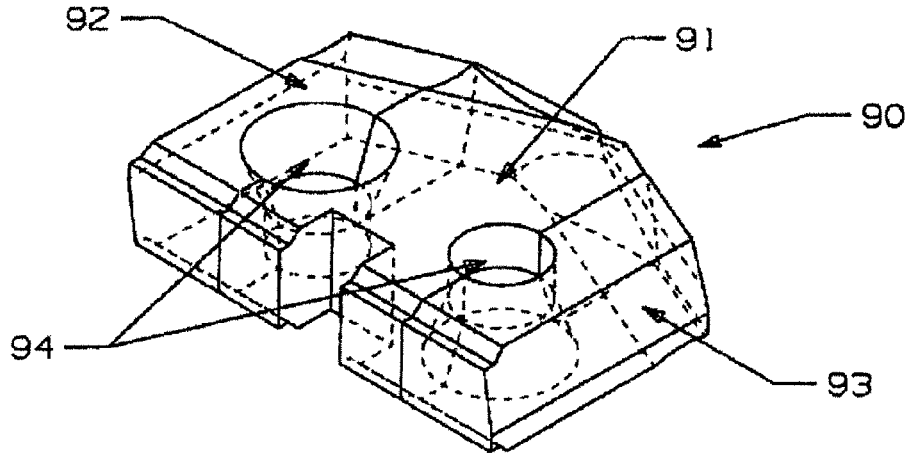
FIGS. 10*a* through 10*c* depict an embodiment of a spade drill insert according to the present disclosure, comprising two regions of composite materials.
Figure 10B:
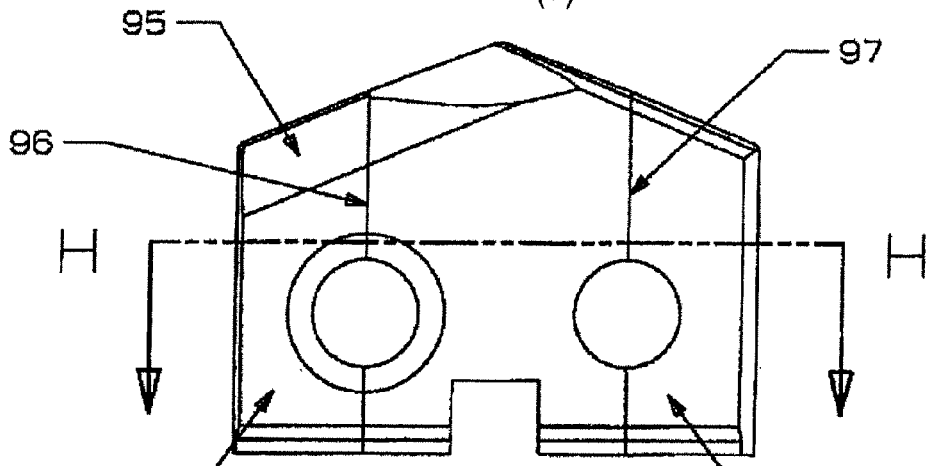
Figure 10C:
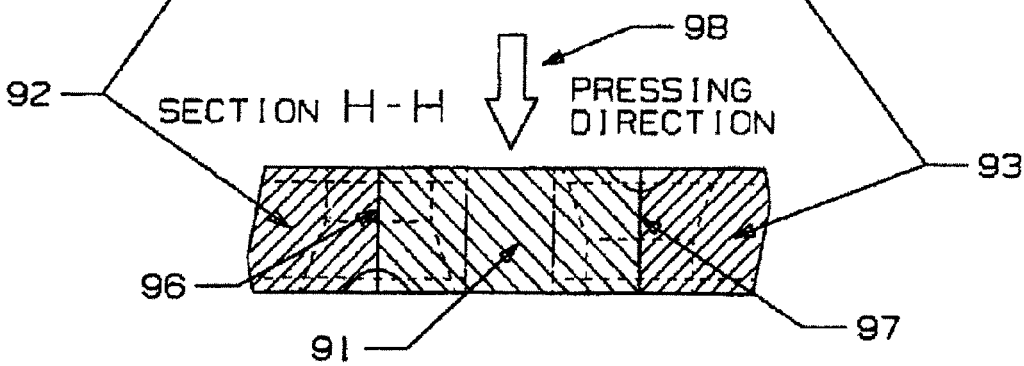

FIGS. 10*a* through 10*c* show an embodiment of a composite spade drill insert 90 according to the present disclosure. Insert 90 has a composite construction of ruthenium featured carbide materials at regions 92 and 93 and a different ruthenium featured carbide material or a non-ruthenium featured carbide material in region 91. The composite cutting tool insert 90 has the shape and geometry of a drilling insert that is usually referred to as a spade drill insert. The composite drilling insert shown in the perspective view of FIG. 10*a* is double-sided, with built-in chip breakers 95 on each side, and two locating holes 94. The boundaries 96 and 97, shown in the top view of FIG. 10*b* and the sectional view of FIG. 10*c*, are boundaries between regions 91 and 92, and between regions 91 and 93, respectively. As shown in FIG. 10*c*, boundaries 96 and 97 are substantially parallel to the powder pressing direction 98.

Figure 11A:
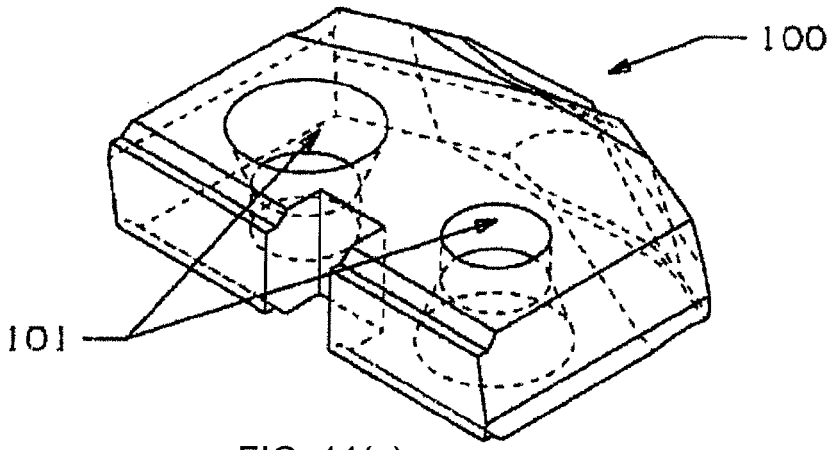
FIGS. 11*a* through 11*c* depict an embodiment of a spade drill insert having the design depicted in FIG. 10*a*, but having a different composite construction comprising two regions of composite materials.
Figure 11B:
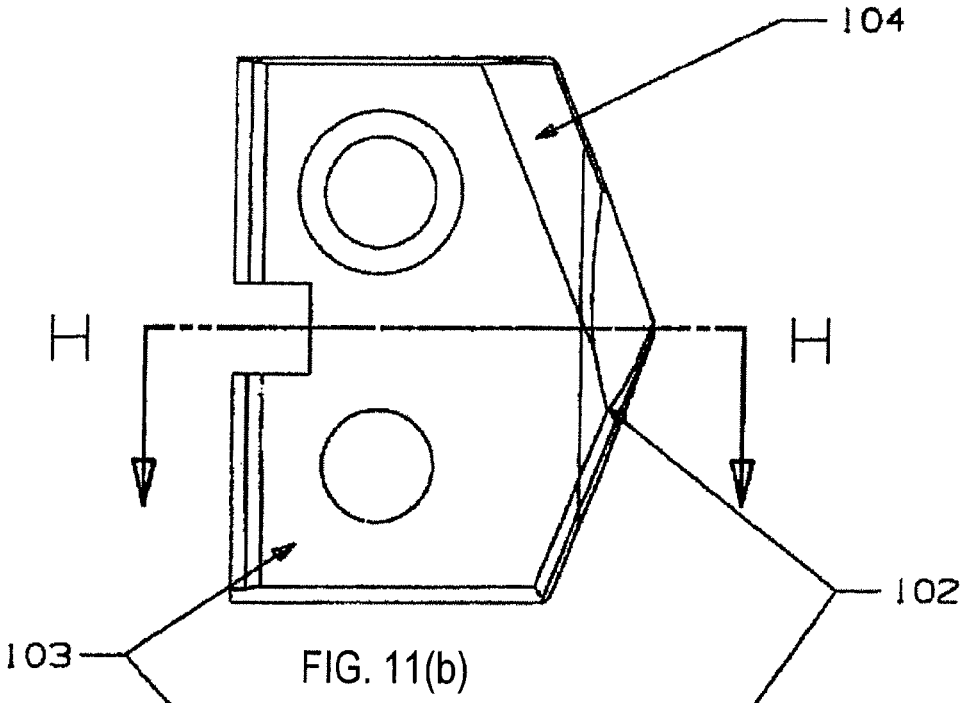
Figure 11C:
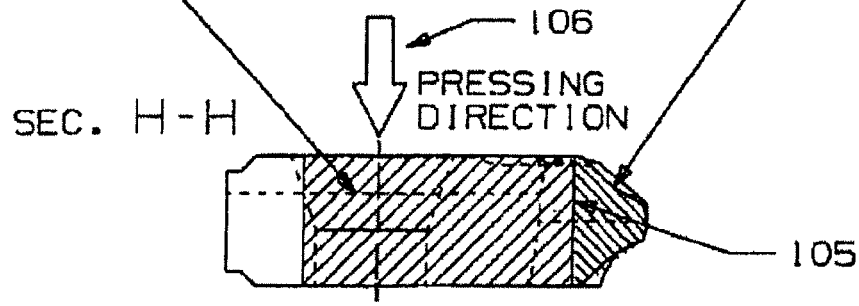
Figure 12:
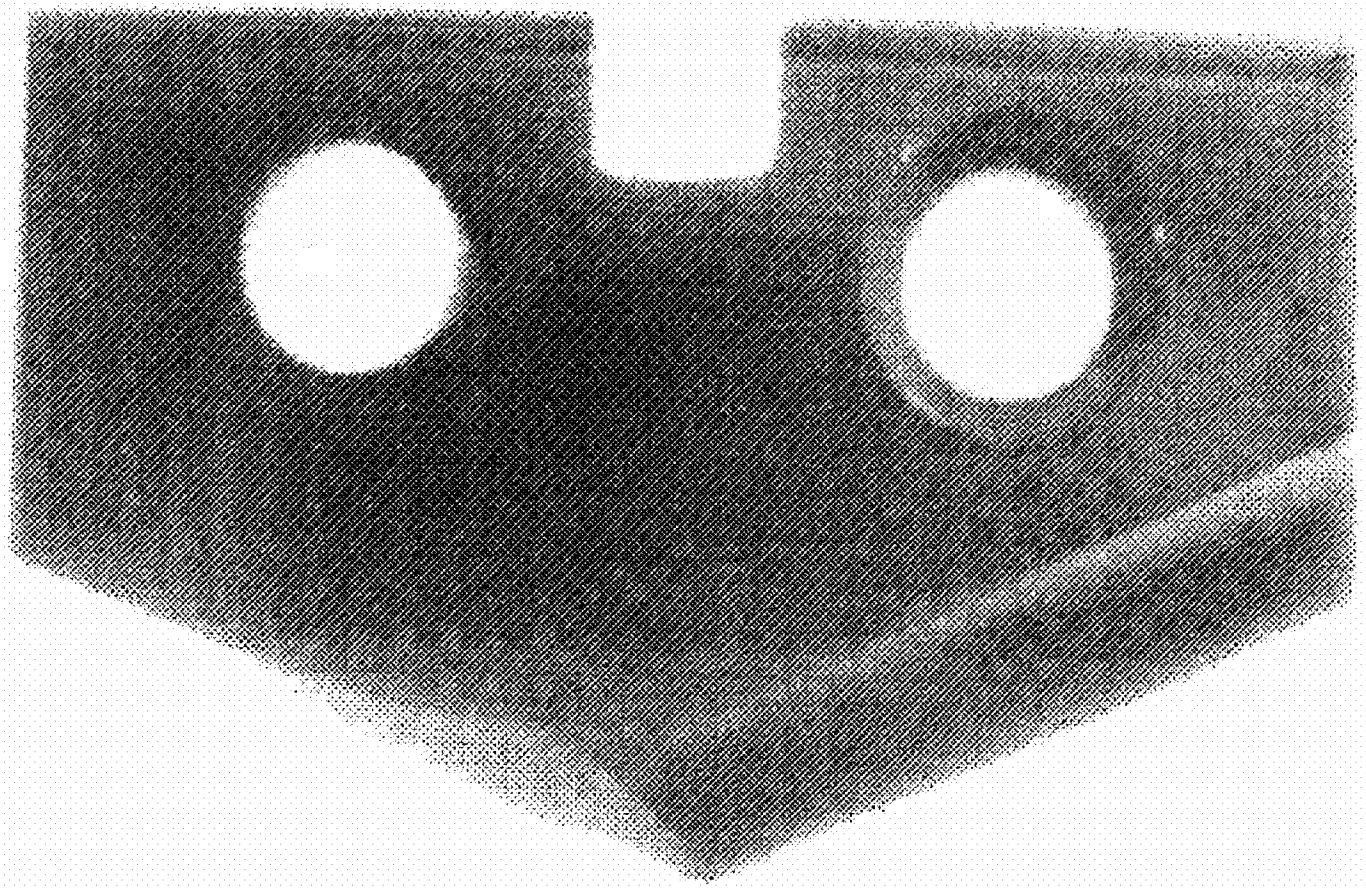
FIG. 12 is a picture of a manufactured sample spade drill insert having the composite construction of FIGS. 11*a* through 11*c*.

A composite drilling insert may be constructed in different ways depending on the specific drilling applications. Shown in FIGS. 11*a* through 11*c* is an embodiment of a drilling insert 100 according to the present disclosure that differs from the embodiment of FIGS. 10*a* through 10*c*. The spade drill insert 100 has two locating holes 101 and built-in chip breakers 104 on both sides. As compared with that the embodiment of FIGS. 10*a-c*, the composite construction of insert 100 has only one boundary 105 that separates the tool tip region 102, comprising a ruthenium featured carbide material, and the region 103, comprising a non-ruthenium featured carbide material. The boundary 105, as shown in the cross-section of FIG. 11*c*, is substantially parallel to the powder pressing direction 106. FIG. 12 is a photo of a manufactured sample spade drill having the composite construction shown generally in FIGS. 11*a-c*.

Figure 13A:
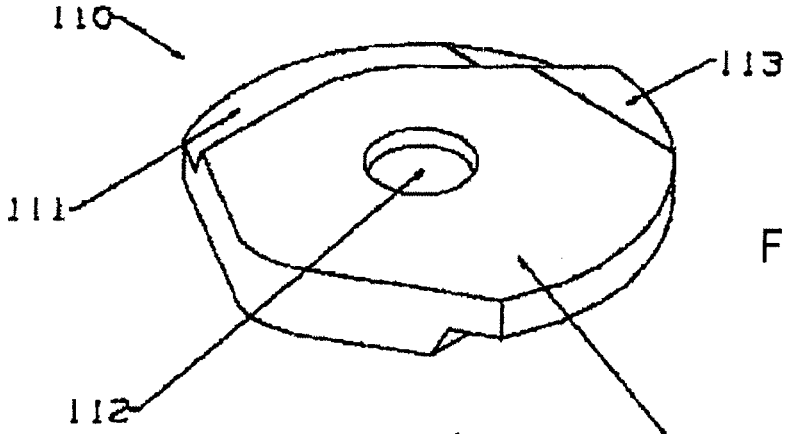
FIGS. 13*a* through 13*c* depict an embodiment of a ballnose cutting tool insert according to the present disclosure, comprising two regions of composite materials.
Figure 13B:
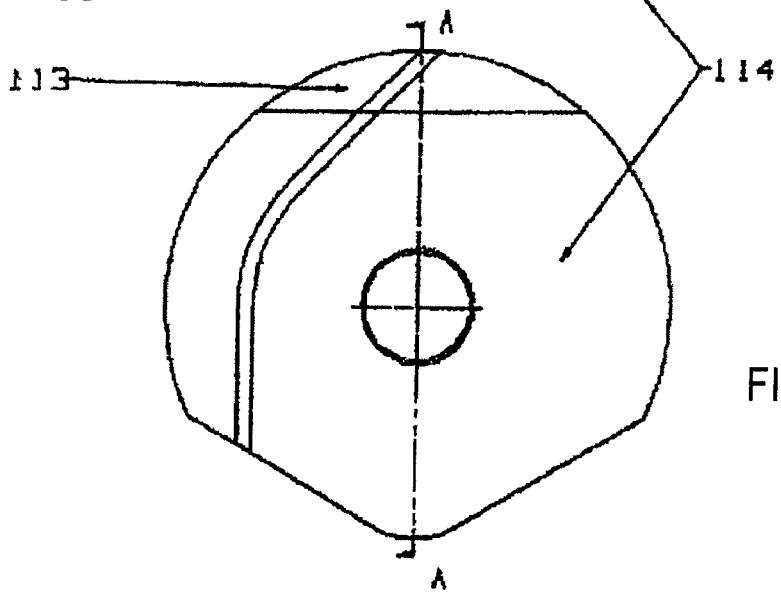
Figure 13C:
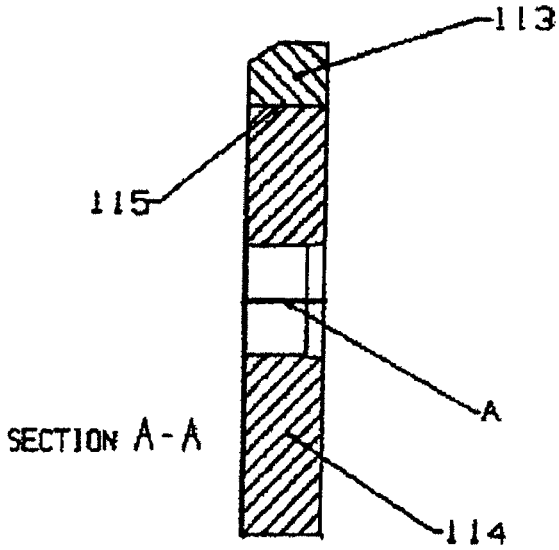
Figure 14:
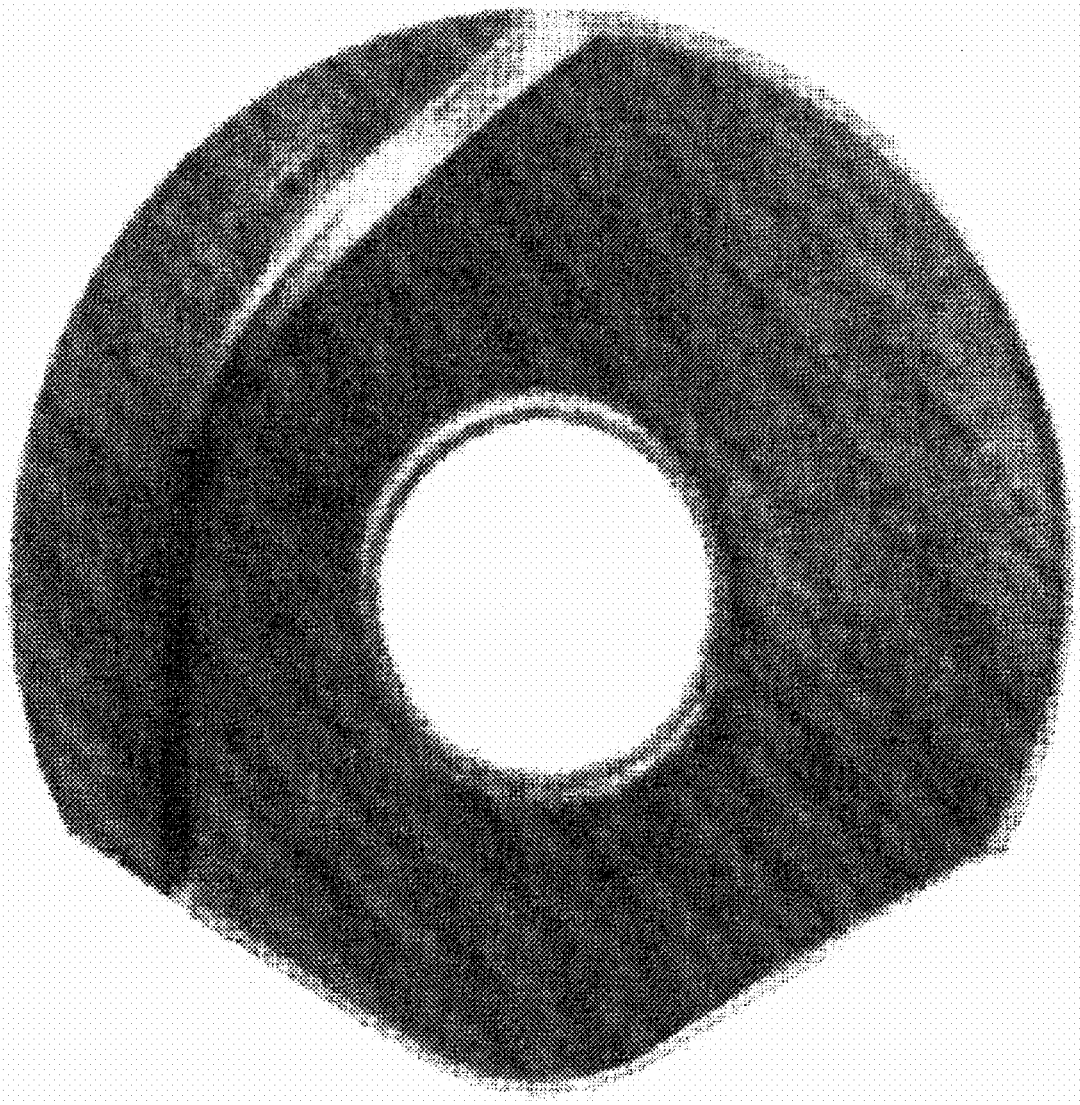
FIG. 14 is a picture of a manufactured sample ball nose cutting insert having the composite construction of FIGS. 13*a* through 13*c*.

FIGS. 13*a* through 13*c* depict an embodiment of a ball nose cutting insert according to the present disclosure, comprising two regions of composite materials. The ballnose cutting insert 110 includes a region 113 comprising a ruthenium featured carbide, and a region 114 comprising a non-ruthenium featured carbide. The ballnose insert 110 includes a center hole 112 and a chip breaker 111. The boundary 115 separates the region 113 and the region 114 and may be described as substantially parallel to the axial line A of the center hole 112. FIG. 14 is a photo of a manufactured sample ball nose cutting insert having the composite construction shown generally in FIGS. 13*a-c*.

Figure 15A:
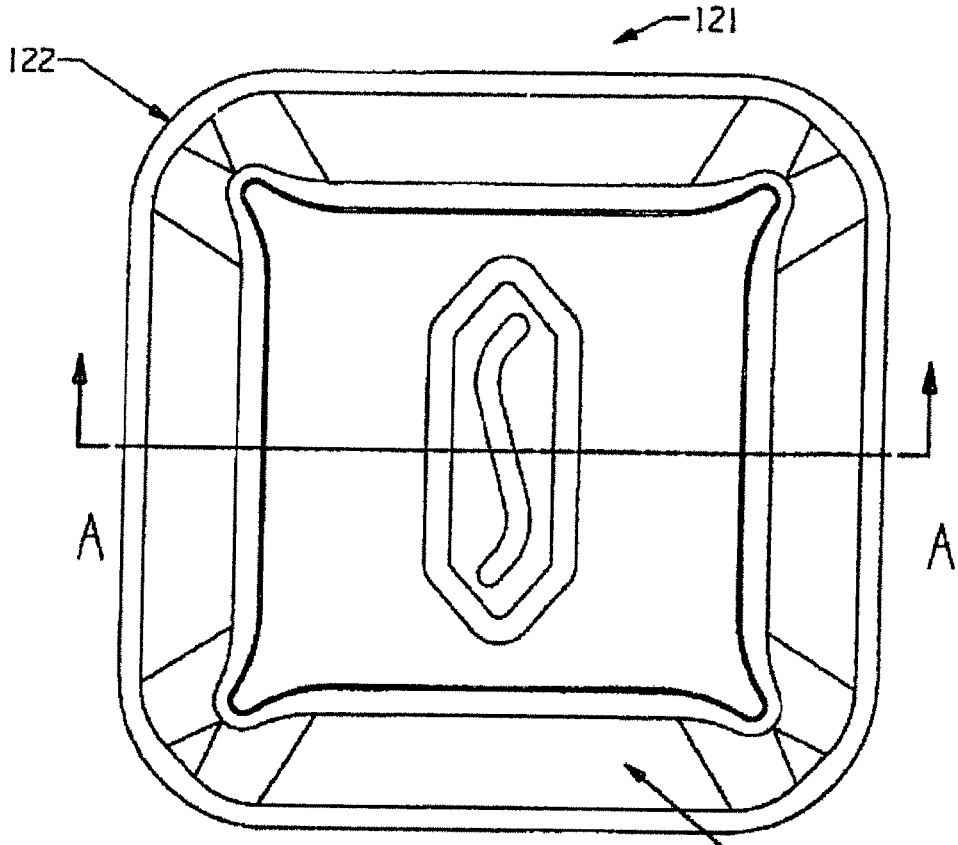
FIGS. 15*a* and 15*b* depict an embodiment of a milling cutting insert according to the present disclosure, having a square shape and four rounded corners, and comprising two regions of composite materials.
Figure 15B:
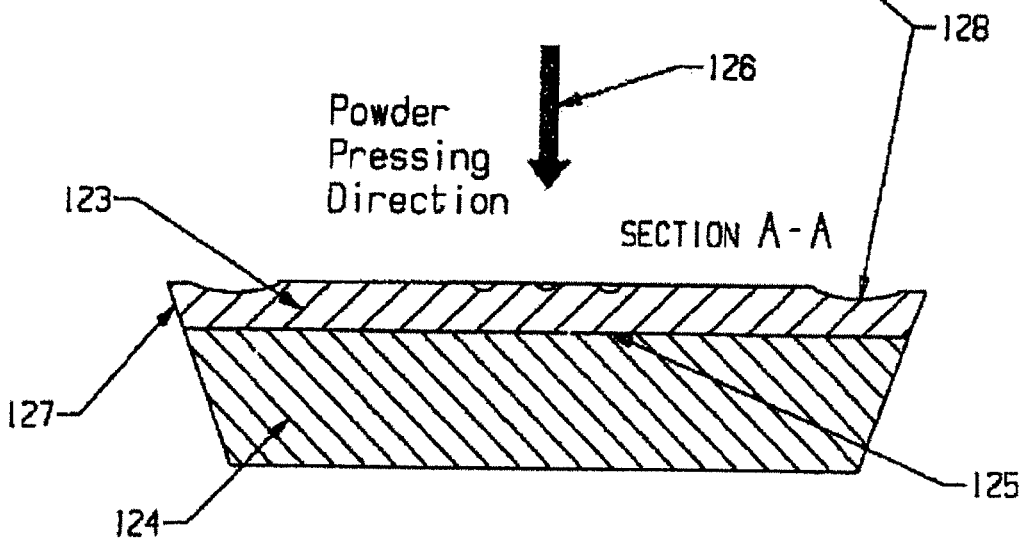
Figure 16:
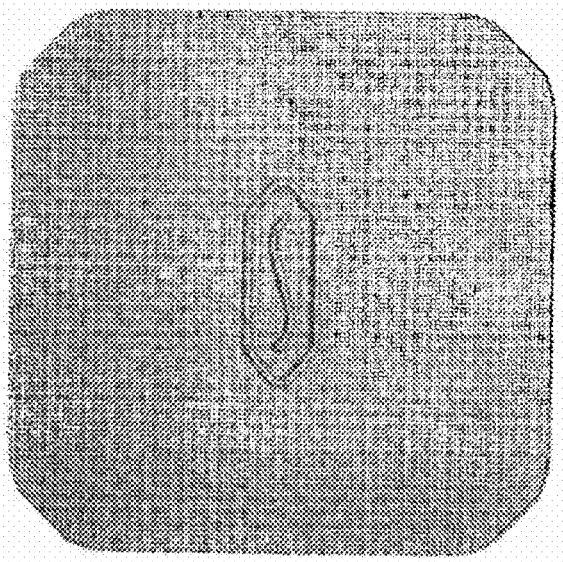
FIGS. 16*a* and 16*b*, respectively, are a picture and a sectioned view of a sample composite cutting tool insert having the composite structure in FIG. 15, and including a ruthenium featured carbide with X44 substrate in a top region and a non-ruthenium featured carbide with H91 substrate in a bottom region.
Figure 16:
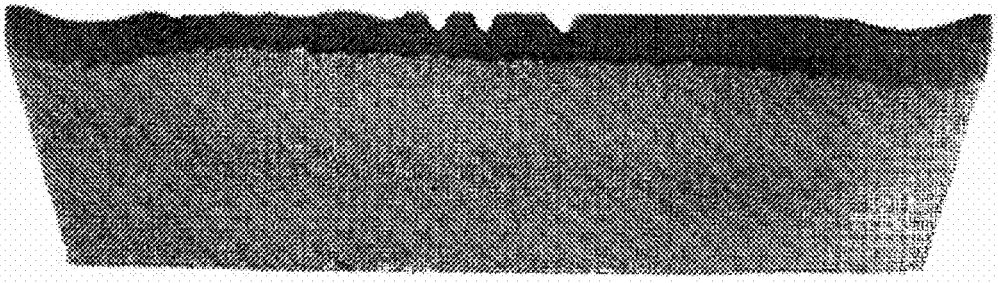

FIGS. 15*a* and 15*b* depict an embodiment of a milling cutting insert according to the present disclosure with a square shape comprising two regions of differing composite materials. The cutting tool insert 121 has four round corners 122, an angled wall 127, and built-in chip breakers 128. Boundary 125 separates the top region 123, containing a ruthenium featured carbide with X44 substrate, and the bottom region 124, containing a non-ruthenium featured carbide with H91 substrate. The boundary 125, as demonstrated in the cross-section of FIG. 15*b*, may be described as substantially perpendicular to the powder pressing direction 126. FIG. 16*a* is a photo and FIG. 16*b* is a section of a sample composite cutting tool insert having the composite construction shown generally in FIGS. 15*a-c*. As indicated in the sectioned view of FIG. 16*b*, the insert includes a ruthenium featured carbide with X44 substrate in a top portion, and a non-ruthenium featured carbide with H91 substrate in a bottom portion. The following example provides details of the manufacturing of the composite cutting tool insert shown generally in FIG. 15*a-c* and 16*a-b*.

EXAMPLE

According to ISO standards for the substrate grade of carbide cutting tool materials, X44 is close to a tough grade between P25 to P50. Powder ingredients (in weight percentages of total powder weight) for X44 are shown in Table 1. The major ingredients include WC, TiC, TaC, NbC, Co and Ru. Certain typical mechanical properties for the sintered X44 tungsten carbides are also listed in Table 1.

TABLE 1

| Ruthenium Featured Carbide X44 | | | | | | | | | |
|---|---|---|---|---|---|---|---|---|---|
| Chemical Compositions (weight %) | | | | | | Average Grain | Transverse Rupture | | |
| WC | TiC | Ta(Nb)C | $Cr_3C_2$ | Co | Ru | Size (μm) | Strength (N/m-m$^2$) | Density (g/cm$^2$) | Hardness (HV) |
| 67.2 | 10 | 9 | 0 | 12 | 1.80 | 1-2 | 2300 | 11.70 | 1500 |

The non-ruthenium featured carbide H91 is a tough milling grade. Powder ingredients for H91 are shown in Table 2. H91 is a carbide substrate without ruthenium. Certain mechanical properties for the sintered H91 tungsten carbides are also listed in Table 2.

TABLE 2

| Non-Ruthenium Featured Carbide H91 | | | | | | | | | |
|---|---|---|---|---|---|---|---|---|---|
| Chemical Compositions (weight %) | | | | | | Average Grain | Transverse Rupture | | |
| WC | TiC | Ta(Nb)C | $Cr_3C_2$ | Co | Ru | Size (μm) | Strength (N/m-m$^2$) | Density (g/cm$^2$) | Hardness (HV) |
| 87.8 | 0.4 | 0.5 | 0 | 11 | 0 | 3-5 | 2850 | 14.30 | 1350 |

A composite cutting tool insert may be produced combining the ruthenium featured carbide X44 and the non-ruthenium featured carbide H91 according to the composite construction illustrated in FIGS. 15*a* and 15*b*, wherein a top portion of the insert contains X44 substrate and a bottom portion contains H91 substrate. A carbide powder for H91 material is first introduced into a portion of the cavity in a die, and then carbide powder for X44 material is introduced into the cavity to fill up the remainder of the die cavity. The two portions of powdered carbide substrate may then be consolidated to form a composite green compact through either a powder pressing process or a powder injection process. Sintering the compact will form a metallurgically bonded composite article having a top region comprising ruthenium featured carbide X44 and a bottom region comprising non-ruthenium featured carbide H91. The distinct regions of differing carbide materials have differing characteristics, which may be selected based on the intended application for the insert.

It is to be understood that the present description illustrates those aspects of the invention relevant to a clear understanding of the invention. Certain aspects of the invention that would be apparent to those of ordinary skill in the art and that, therefore, would not facilitate a better understanding of the invention have not been presented in order to simplify the present description. Although only a limited number of embodiments of the present invention necessarily are described herein, one of ordinary skill in the art will, upon considering the foregoing description, recognize that many modifications and variations of the invention may be employed. All such variations and modifications of the invention are intended to be covered by the foregoing description and the following claims.

We claim:

1. A composite cutting tool for machining of metals and metallic alloys, comprising:

a first region comprising a first composite material; and a second region metallurgically bonded to the first region and comprising a second composite material, wherein the first composite material and the second composite material individually comprise hard particles and a binder, wherein the binder of at least one of the first composite material and the second composite material comprises ruthenium, and wherein a concentration of ruthenium in the binder of the first composite material is different from a concentration of ruthenium in the binder of the second composite material.

2. The composite cutting tool of claim 1, wherein the composite cutting tool comprises a cutting tool insert selected from the group consisting of a turning insert, a milling insert, a drilling insert, a reaming insert, a threading insert, a grooving insert, a boring insert, and a tapping insert.

3. The composite cutting tool of claim 1, wherein the composite cutting tool is selected from the group consisting of a ballnose end mill, a ballnose cutting insert, a spade drill insert, and a cut-off cutting insert.

4. The composite cutting tool of claim 1, wherein the composite cutting tool is one of an indexable cutting tool insert and a non-indexable cutting tool insert.

5. The composite cutting tool of claim 1, wherein the binder of the first composite material comprises from 1 weight percent to 30 weight percent ruthenium, based on the total weight of the binder of the first composite material.

6. The composite cutting tool of claim 1, wherein the binder of the first composite material comprises from 5 weight percent to 30 weight percent ruthenium, based on the total weight of the binder of the first composite material.

7. The composite cutting tool of claim 1, wherein a concentration of ruthenium in the binder of the first composite material and a concentration of ruthenium in the binder of the second composite material differ by at least 1 weight percent.

8. The composite cutting tool of claim 1, wherein a concentration of ruthenium in the binder of the first composite material and a concentration of ruthenium in the binder of the second composite material differ by at least 5 weight percent.

9. The composite cutting tool of claim 1, wherein the binder of the second composite material either lacks ruthenium or comprises an incidental amount of ruthenium.

10. The composite cutting tool of claim 1, wherein the hard particles of the first composite material and the hard particles of the second composite material independently comprise at least one of a carbide, a nitride, a boride, a silicide, an oxide, and solid solutions thereof, and wherein the binder of the first composite material and the binder of the second composite material independently comprise at least one of cobalt, cobalt alloy, nickel, nickel alloy, iron, iron alloy, ruthenium, ruthenium alloy, palladium, and palladium alloy.

11. The composite cutting tool of claim 1, wherein the first composite material and the second composite material differ in at least one characteristic selected from the group consisting of composition, grain size, modulus of elasticity, hardness, wear resistance, fracture toughness, tensile strength, corrosion resistance, coefficient of thermal expansion, and coefficient of thermal conductivity.

12. The composite cutting tool of claim 1, wherein the hard particles of the first composite material and the hard particles of the second composite material are individually selected from the group consisting of titanium carbides, chromium carbides, vanadium carbides, zirconium carbides, hafnium carbides, molybdenum carbides, tantalum carbides, tungsten carbides, and niobium carbides.

13. The composite cutting tool of claim 1, wherein the binder of the first composite material and the binder of the second composite material each individually comprise at least one metal selected from the group consisting of cobalt, nickel, ruthenium, palladium, and iron.

14. The composite cutting tool of claim 1, wherein at least a region of a surface of the composite cutting tool is coated with at least one coating selected from the group consisting of a CVD coating, a PVD coating, a diamond coating, a laser-based coating, and a nanotechnology-based coating.

15. The composite cutting tool of claim 14, wherein the at least one coating comprises at least one material selected from the group consisting of a metal carbide, a metal nitride, a metal silicide, and a metal oxide, wherein the metal is selected from groups IIIA, IVB, VB, and VIB of the periodic table.

16. The composite cutting tool of claim 14, wherein the at least one coating comprises a material selected from the group consisting of titanium nitride (TiN), titanium carbon (TiC), titanium carbonitride (TiCN), titanium aluminum nitride (TiAlN), titanium aluminum nitride plus carbon (TiAlN+C), aluminum titanium nitride (AlTiN), aluminum titanium nitride plus carbon (AlTiN+C), titanium aluminum nitride plus tungsten carbide/carbon (TiAlN+WC/C), aluminum titanium nitride (AlTiN), aluminum titanium nitride plus carbon (AlTiN+C), aluminum titanium nitride plus tungsten carbide/carbon (AlTiN+WC/C), aluminum oxide ($Al_2O_3$), alpha alumina oxide ($\alpha Al_2O_3$), titanium diboride ($TiB_2$), tungsten carbide carbon (WC/C), chromium nitride (CrN), hafnium carbonitride (HfCN), zirconium nitride (ZrN), zirconium carbon nitride (ZrCN), boron nitride (BN), boron carbon nitride (BCN), and aluminum chromium nitride (AlCrN).

17. The composite cutting tool of claim 14, wherein the at least one coating comprises multiple layers.

18. The composite cutting tool of claim 14, wherein the at least one coating comprises at least three layers and wherein at least one layer has a composition that differs from at least one other layer.

19. The composite cutting tool of claim 1, wherein:

the first region is a surface region of the cutting tool including a cutting edge of the cutting tool and the second region is a core region of the cutting tool;

a concentration of ruthenium in the binder of the surface region is greater than a concentration of ruthenium in the binder of the core region;

wear resistance of the surface region is greater than wear resistance of the core region; and toughness of the core region is greater than toughness of the surface region.

20. The composite cutting tool of claim 1, wherein the cutting tool is an indexable cutting insert comprising:

a top region consisting of the first composite material and including a cutting edge; and a bottom region consisting of the second composite material and metallurgically bonded to the top region;

wherein a concentration of ruthenium in the binder of the first composite material is greater than a concentration of ruthenium in the binder of the second composite material, wherein wear resistance of the top region is greater than wear resistance of the bottom region, and wherein toughness of the bottom region is greater than toughness of the top region.

21. The composite cutting tool of claim 1, wherein the cutting tool is an indexable cutting insert comprising:

a top region consisting of the first composite material and including a cutting edge;

a bottom region consisting of the first composite material and including a cutting edge; and a middle region consisting of the second composite material and metallurgically bonded to the top region and the bottom region;

wherein a concentration of ruthenium in the binder of the first composite material is greater than a concentration of ruthenium in the binder of the second composite material, wherein wear resistance of the top region and the bottom region is greater than wear resistance of the middle region, and wherein toughness of the middle region is greater than toughness of the top region and the bottom region.

22. The composite cutting tool of claim 1, wherein the cutting tool is a drilling insert comprising:

a first side region consisting of the first composite material and including a cutting edge;

a second side region consisting of the first composite material and including a cutting edge; and a tip region consisting of the second composite material and metallurgically bonded to the first side region and the second side region;

wherein a concentration of ruthenium in the binder of the first composite material is greater than a concentration of ruthenium in the binder of the second composite material, wherein wear resistance of the first side region and the second side region is greater than wear resistance of the tip region, and wherein toughness of the tip region is greater than toughness of the first side region and the second side region.

23. A composite cutting tool insert for machining of metals and metallic alloys selected from the group consisting of indexable turning inserts, indexable milling inserts, and indexable drilling inserts, the cutting tool insert comprising:

a first region consisting of a first cemented carbide composite material and including a cutting edge; and a second region metallurgically bonded to the first region and consisting of a second cemented carbide composite material, wherein the first cemented carbide composite material and the second cemented carbide composite material individually comprise carbide particles in a binder, wherein the binder of the first cemented carbide composite material comprises 5 weight percent to 30 weight percent ruthenium, and wherein the binder of the second cemented carbide composite material either lacks ruthenium or comprises an incidental amount of ruthenium.

24. A composite cutting tool insert for machining of metals and metallic alloys selected from the group consisting of end mill inserts and spade drill inserts, the cutting tool insert comprising:

a first region consisting of a first cemented carbide composite material and including a cutting edge; and a second region metallurgically bonded to the first region and consisting of a second cemented carbide composite material, wherein the first cemented carbide composite material and the second cemented carbide composite material individually comprise carbide particles in a binder, wherein the binder of the first cemented carbide composite material comprises 5 weight percent to 30 weight percent ruthenium, and wherein the binder of the second cemented carbide composite material either lacks ruthenium or comprises an incidental amount of ruthenium.

* * * * *